US007475960B2

(12) United States Patent
Oku

(10) Patent No.: US 7,475,960 B2
(45) Date of Patent: Jan. 13, 2009

(54) LIQUID EJECTION APPARATUS AND EJECTION ABNORMALITY DETERMINATION METHOD

(75) Inventor: Seiichiro Oku, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 422 days.

(21) Appl. No.: 11/237,740

(22) Filed: Sep. 29, 2005

(65) Prior Publication Data

US 2006/0071964 A1 Apr. 6, 2006

(30) Foreign Application Priority Data

Sep. 30, 2004 (JP) ..... 2004-288784

(51) Int. Cl.
*B41J 29/393* (2006.01)
*B41J 2/045* (2006.01)

(52) U.S. Cl. ..... 347/19; 347/68

(58) Field of Classification Search ..... 347/68, 347/70–72, 19
See application file for complete search history.

(56) References Cited

U.S. PATENT DOCUMENTS 6,243,542 B1 * 6/2001 Fujimoto et al. ..... 399/49
6,604,807 B1 * 8/2003 Murcia et al. ..... 347/19
6,702,418 B2 * 3/2004 Satou et al. ..... 347/19
7,097,270 B2 * 8/2006 Yamazaki ..... 347/19

FOREIGN PATENT DOCUMENTS

JP 11-99646 A 4/1999
JP 2004195705 A * 7/2004

* cited by examiner

*Primary Examiner*—An H Do
(74) *Attorney, Agent, or Firm*—Birch, Stewart, Kolasch & Birch, LLP

(57) ABSTRACT

The liquid ejection apparatus includes: ejection head which includes: a nozzle through which a droplet of liquid is ejected onto an ejection receiving medium; a pressure chamber which accommodates the liquid to be ejected from the nozzle; and a piezoelectric element which is provided at the pressure chamber and applies an ejection force to the liquid inside the pressure chamber; a pressure sensor which is provided at the pressure chamber and generates a determination signal corresponding to pressure in the pressure chamber; an integration device which integrates the determination signal obtained by the pressure sensor for a prescribed integration time period; and an ejection abnormality judgment device which judges whether or not an ejection abnormality occurs in the nozzle, according to a comparison result of comparing an integration result obtained from the integration device with a previously established threshold value.

11 Claims, 15 Drawing Sheets

LIQUID EJECTION APPARATUS AND EJECTION ABNORMALITY DETERMINATION METHOD

BACKGROUND OF THE INVENTION

1. Field of the Invention

The present invention relates to a liquid ejection apparatus and an ejection abnormality determination method, and more particularly, to ejection abnormality determination technology for nozzles which eject liquid droplets onto an ejection receiving medium.

2. Description of the Related Art

An inkjet recording apparatus having an inkjet type of ejection head forms a desired image on a medium by ejecting ink from a plurality of nozzles provided in the ejection head. In this inkjet recording apparatus, if an ejection abnormality occurs due to blocking of a nozzle as a result of drying (increased viscosity) of the ink, or intermixing of air bubbles, foreign matter, or the like, into the nozzles or pressure chambers, then the quality of the image formed on the medium will deteriorate. In particular, in a full line type ejection head having a nozzle row of a width equal to or exceeding the printable width of the medium, if there is an ejection abnormality in a particular nozzle, banding (color non-uniformities) arises in a direction substantially perpendicular to the breadthways direction of the ejection head and the quality of the image formed on the medium deteriorates markedly.

Various methods have been proposed for determining ejection abnormalities in nozzles in an inkjet recording apparatus. For example, it is possible to determine a pressure abnormality in a pressure chamber and thus determine an ejection abnormality in that pressure chamber, by providing pressure sensors in the pressure chambers and using a method which measures the frequency characteristics of the pressure (pressure wave) obtained from the pressure sensors, or a method which measures the current and voltage waveforms, or level (peak) obtained from the pressure sensors.

In the inkjet head and inkjet recording apparatus described in Japanese Patent Application Publication No. 11-99646, measurement is made of the change over time in the amount of charge flowing into a piezoelectric element due to vibration of the piezoelectric element, and hence the pressure wave in the ink pressure chamber is ascertained and an increase in fluid resistance can be detected in cases where air bubbles are present in the ink flow channel or where dirt or the like is present.

However, in a method which measures the frequency characteristics of the pressure (pressure wave) in the pressure chamber, it is necessary to scan the frequency characteristics from a low frequency to a high frequency, and this means that processing of the measurement results becomes complicated and it is difficult to make a judgment in a short period of time. Furthermore, in a method which measures the current and voltage waveforms and voltage level obtained from the piezoelectric elements, pulse noises are often superimposed on the current and voltage waveforms and voltage level obtained from the piezoelectric elements, and therefore the determination results are liable to be affected by the noises.

In the inkjet head and the inkjet recording apparatus described in Japanese Patent Application Publication No. 11-99646, a noise component is liable to be superimposed on the pressure waveform (determination signal) obtained from the piezoelectric elements, and therefore the signal has a low S/N ratio and the ejection abnormality determination results are liable to be affected by noise.

SUMMARY OF THE INVENTION

The present invention has been contrived in view of the foregoing circumstances, an object thereof being to provide a liquid ejection apparatus and ejection abnormality determination method which determine (measure) pressure abnormalities in pressure chambers, and determine ejection abnormalities in the nozzles of the pressure chambers, on the basis of pressure abnormalities in the pressure chambers.

In order to attain the aforementioned object, the present invention is directed to a liquid ejection apparatus, comprising: an ejection head which includes: a nozzle through which a droplet of liquid is ejected onto an ejection receiving medium; a pressure chamber which accommodates the liquid to be ejected from the nozzle; and a piezoelectric element which is provided at the pressure chamber and applies an ejection force to the liquid inside the pressure chamber; a pressure sensor which is provided at the pressure chamber and generates a determination signal corresponding to pressure in the pressure chamber; an integration device which integrates the determination signal obtained by the pressure sensor for a prescribed integration time period; and an ejection abnormality judgment device which judges whether or not an ejection abnormality occurs in the nozzle, according to a comparison result of comparing an integration result obtained from the integration device with a previously established threshold value.

According to the present invention, a determination signal corresponding to the- pressure in the pressure chamber is obtained, and the presence or absence of an ejection abnormality is judged on the basis of the comparison result of comparing the integrated value of the determination signal with a previously established threshold value. Therefore, if residual vibration occurs in the pressure wave of the pressure chamber after ejection of the liquid, due to change in the resonance frequency of the liquid ejection system of the ejection head due to an ejection abnormality, then it is possible to judge the ejection abnormality with good accuracy. Furthermore, it is also possible to reduce the effects of noise which is superimposed on the determination signal.

In general, the shape (size) of a pressure chamber is specified in such a manner that transient phenomena (residual vibrations) do not occur in the pressure wave of the pressure chamber after ejection, and an optimal waveform is specified for the drive signal applied to the piezoelectric element, in accordance with the ejection frequency.

A piezoelectric element is used as a pressure sensor for determining the pressure of the pressure chamber, and this piezoelectric element may also serve as the piezoelectric element which applies an ejection force to the liquid inside the pressure chamber.

An ejection abnormality may be an ejection failure in which no liquid is ejected, an ejection volume abnormality in which the ejection volume of the liquid differs from the originally intended ejection volume, an ejection direction abnormality in which the direction of ejection of the liquid differs from the originally intended direction, or the like.

A recording device (storage device) for sequentially recording (storing) the comparison result of the integrated value of the determination signal and the threshold value may be provided, and the comparison results recorded by this recording device may be read out at a prescribed timing and the presence or absence of an ejection abnormality judged on the basis of the comparison result thus read out.

The term "ejection receiving medium" indicates a medium on which an image is recorded by means of the action of the ejection head (this medium may also be called an ejection receiving medium, print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of an ink jet head, and the like.

The ejection head may be a full line type head in which ejection holes are arranged through a length corresponding to the entire width of the ejection receiving medium, or a serial type head (shuttle scanning type head) in which a short head having ejection holes arranged through a length that is shorter than the entire width of the ejection receiving medium ejects recording liquid onto the ejection receiving medium while scanning in the breadthways direction of the ejection receiving medium.

A full line ejection head may be formed to a length corresponding to the full width of the ejection receiving medium by combining short head having rows of ejection holes which do not reach a length corresponding to the full width of the ejection receiving medium, these short heads being joined together in a staggered matrix fashion.

Preferably, the integration time period comprises: a first integration time period including an end time of a drive signal supplied to the piezoelectric element during one ejection operation and having a time period after an end of the drive signal which exceeds a half of a resonance period of a liquid ejection system of the ejection head; and a second integration time period including a time period during which the drive signal is supplied to the piezoelectric element in one ejection operation, and having a time period shorter than the first integration time period; the threshold value includes a first threshold value specified in accordance with the first integration time period and a second threshold value specified in accordance with the second integration time period; and the ejection abnormality judgment device judges whether or not an ejection abnormality occurs in the nozzle according to at least one comparison result of a first comparison result obtained by comparing an integrated value for the first integration time period with the first threshold value, and a second comparison result obtained by comparing an integrated value for the second integration time period with a second threshold value.

Residual vibration occurring in the pressure wave of the pressure chamber due to change in the resonance frequency of the liquid ejection system of the ejection head can be determined from the first comparison result obtained by comparing the integrated value determined for the first integration time period with the first threshold value, and the maximum value of the pressure wave of the pressure chamber can be determined from the second comparison result obtained by comparing the integrated value determined for the second integration time period with the second threshold value. Furthermore, the residual vibration and the maximum value of the pressure wave can be determined respectively and independently from one determination signal.

The liquid ejection system of the ejection head includes a nozzle forming an ejection side flow channel, and a pressure chamber, and furthermore, it also includes a supply side flow channel which supplies liquid to the pressure chamber.

The pressure wave of the pressure chamber is a maximum at substantially the same timing as the timing at which liquid is ejected from the nozzle, and the timing at which the pressure wave reaches a maximum is included in the second integration time period.

Preferably, an ejection abnormality in the nozzle due to an occurrence of an air bubble in at least one of the nozzle and the pressure chamber is judged from the first and second comparison results.

If an air bubble occurs inside the nozzle or inside the pressure chamber, then the pressure in the pressure chamber decreases (there is a pressure loss), and an ejection failure occurs whereby no liquid is ejected from the nozzle, or an ejection volume abnormality occurs whereby the ejected volume of liquid becomes too small. As well as a reduction in the maximum value of the pressure wave, there is also a reduction in the integrated value due to the effects of the residual vibration occurring in the pressure wave. Consequently, from the residual vibration and the maximum value of the pressure wave, it is possible to determine the occurrence of an air bubble inside the nozzle or inside the pressure chamber which is giving rise to an ejection abnormality.

Preferably, an ejection abnormality in the nozzle due to increased viscosity of the liquid inside the nozzle is judged from the second comparison result.

If an ejection abnormality occurs in a nozzle due to increased viscosity of the liquid in that nozzle, then the maximum value of the pressure wave increases, and therefore, it is possible to determine an ejection abnormality due to increased viscosity of the liquid inside the nozzle, from the second comparison result.

Preferably, the first integration time period and the second integration time period have a common start timing.

If a common start timing is adopted for the first and second integration time periods, then it is possible to unify a portion of the calculation processing for the integrated values of the respective integration time periods, and hence the processing load can be reduced.

Preferably, the integration device calculates an integrated absolute value by integrating an absolute value of the determination signal.

If the determination signal corresponding to the pressure wave is simply integrated (by adding positive numbers and subtracting negative numbers), then in residual vibration having substantially the same amplitude in the positive direction and the negative direction, the positive and negative amplitudes will cancel each other out and determination thereof will be difficult. Therefore, an integrated absolute value is calculated by integrating the absolute value of the determination signal, and the presence or absence of residual vibration having substantially the same amplitude in the positive direction and the negative direction can be determined on the basis of the comparison result of comparing this integrated absolute value with a prescribed threshold value.

Furthermore, it is possible to determine (judge), with good accuracy, an ejection abnormality due to increased viscosity of the liquid inside a nozzle where the pressure wave has increased in amplitude and become harder to damp.

Preferably, the liquid ejection apparatus further comprises: a calculation device which determines an amount of increase in the integrated absolute value, wherein the ejection abnormality judgment device judges an ejection abnormality in the nozzle according to the amount of increase in the integrated absolute value determined by the calculation device.

As a mode for determining the amount of increase in the integrated absolute value, it is possible to determine the amount of increase in the whole integration time period, and it is also possible to determine the amount of increase per unit time.

In order to attain the aforementioned object, the present invention is also directed to an ejection abnormality determination method for an ejection head which includes: a nozzle through which a droplet of liquid is ejected onto an ejection receiving medium; a pressure chamber which accommodates the liquid to be ejected from the nozzle; and a piezoelectric element which is provided at the pressure chamber and applies an ejection force to the liquid inside the pressure chamber, the method comprising the steps of: acquiring a determination signal corresponding to pressure in the pressure chamber; integrating the determination signal; and judging whether or not an ejection abnormality occurs in the nozzle, according to a comparison result obtained by comparing an integration result obtained in the integration step with a previously established threshold value.

According to the present invention, since the determination signal obtained from a pressure sensor provided in a pressure chamber is integrated for a prescribed integrated time period and an ejection abnormality in the nozzle connected to the pressure chamber is judged from the comparison result of comparing this integration result with a prescribed threshold value, then it is possible to carry out desirable ejection abnormality determination in which the effects of noise contained in the determination signal are reduced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
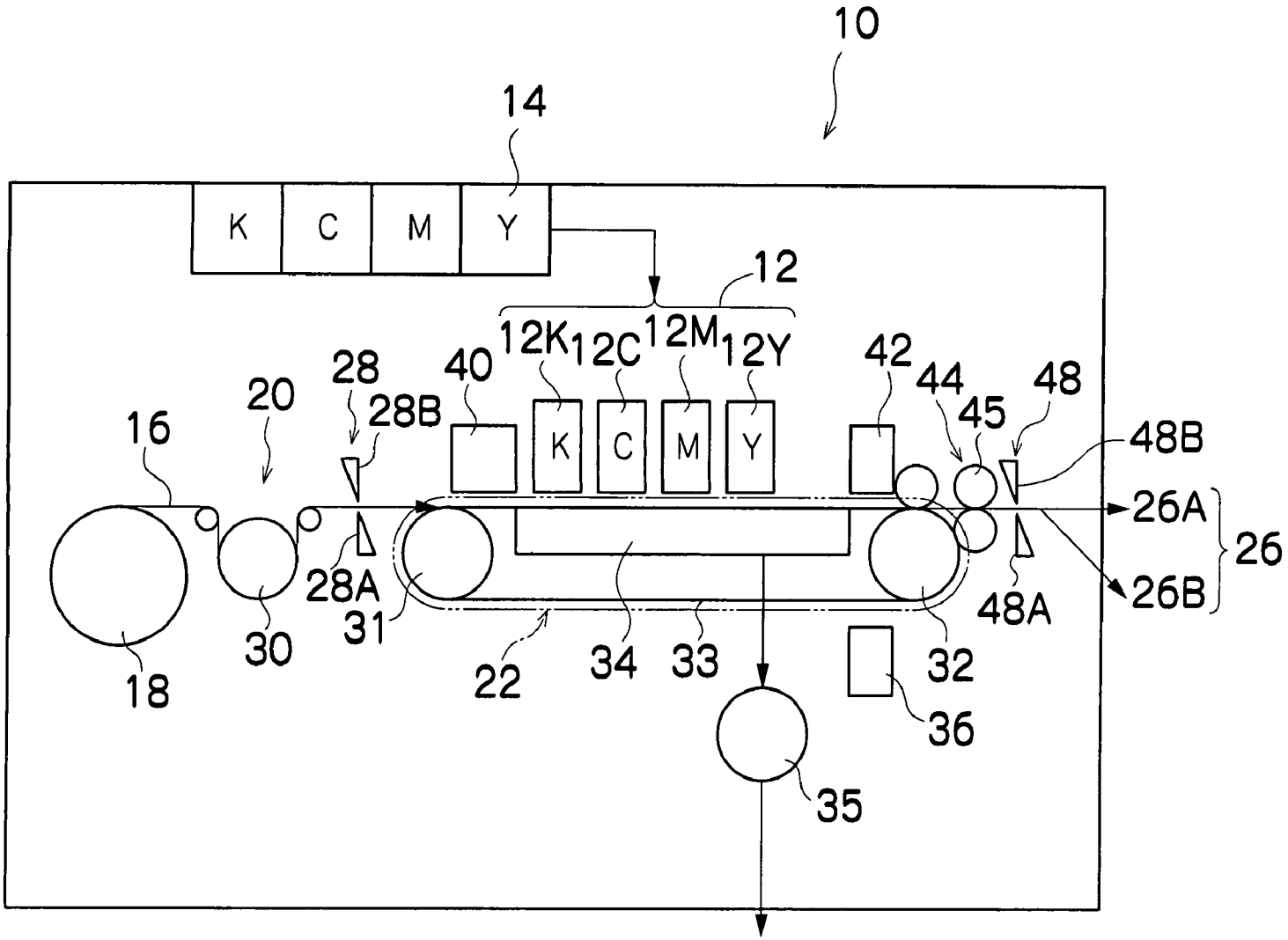
FIG. 1 is a general schematic drawing of an inkjet recording apparatus according to an embodiment of the present invention.

FIG. 1 is a general schematic drawing of an inkjet recording apparatus using an image processing apparatus according to an embodiment of the present invention. As shown in FIG. 1, the inkjet recording apparatus 10 comprises: a printing unit 12 having a plurality of ejection heads 12K, 12C, 12M, and 12Y provided for ink colors of black (K), cyan (C), magenta (M), and yellow (Y), respectively; an ink storing and loading unit 14 for storing inks of K, C, M and Y to be supplied to the heads 12K, 12C, 12M, and 12Y; a paper supply unit 18 for supplying recording paper 16, which forms a recording medium (ejection receiving medium); a decurling unit 20 removing curl in the recording paper 16; a suction belt conveyance unit 22 disposed facing the nozzle face (ink-droplet ejection face) of the print unit 12, for conveying the recording paper 16 while keeping the recording paper 16 flat; and a paper output unit 26 for outputting printed recording paper (printed matter) to the exterior.

The ink storing and loading unit 14 has ink tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle face of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (shown in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
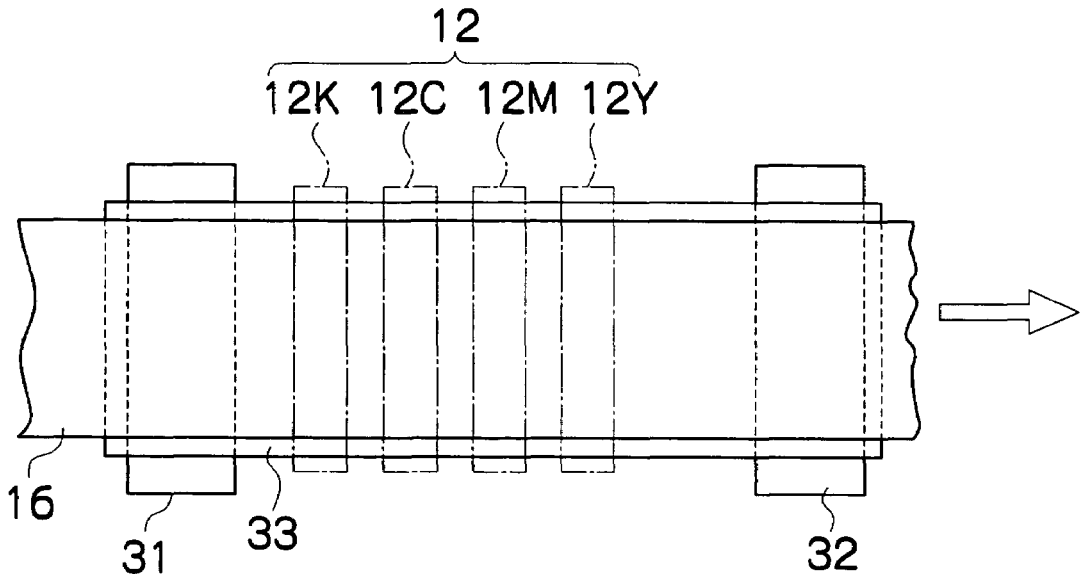
FIG. 2 is a plan view of the principal part of the peripheral area of a print unit in the inkjet recording apparatus shown in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks or dark inks can be added as required. For example, a configuration is possible in which inkjet heads for ejecting light-colored inks such as light cyan and light magenta are added. Furthermore, there are no particular restrictions of the sequence in which the heads of respective colors are arranged.

A post-drying unit 42 is disposed following the print unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of a head will be described. The heads 12K, 12C, 12M and 12Y of the respective ink colors have the same structure, and a reference numeral 50 is hereinafter designated to any of the heads.

Figure 3A:
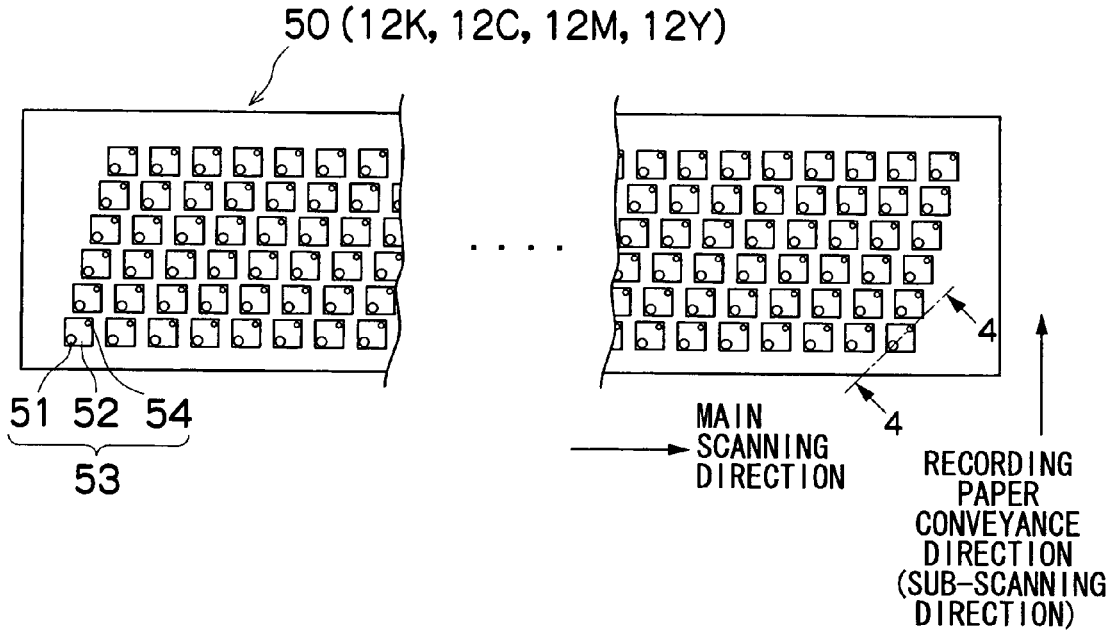
FIGS. 3A to 3C are plan view perspective diagrams showing an example of the composition of a print head.
Figure 3B:
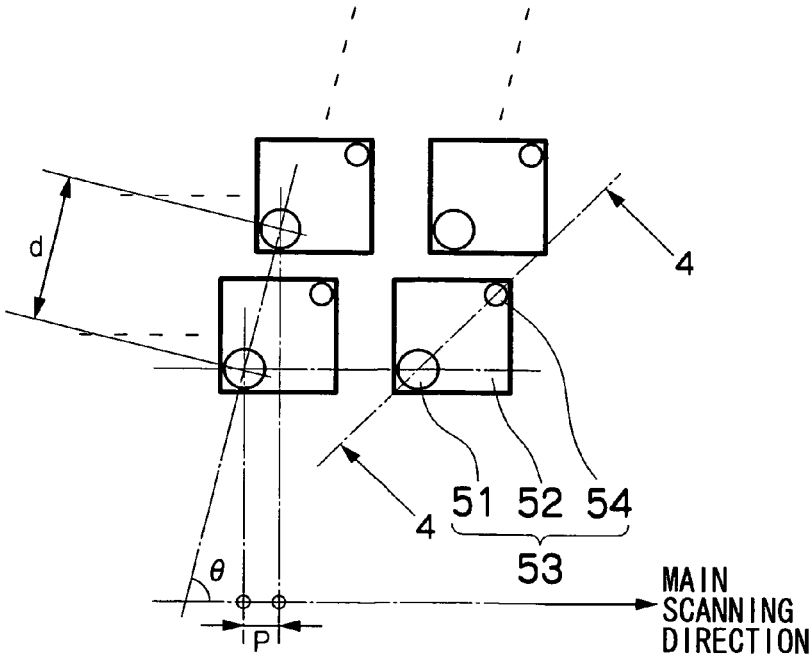
Figure 3C:
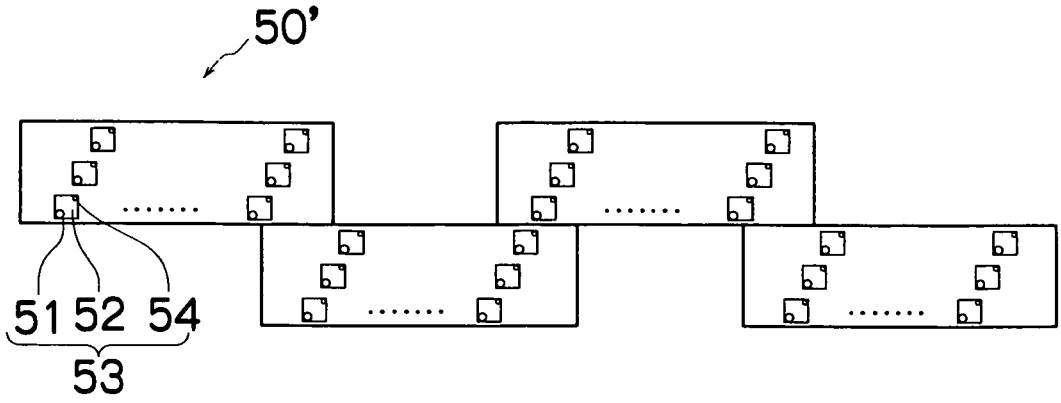
Figure 4:
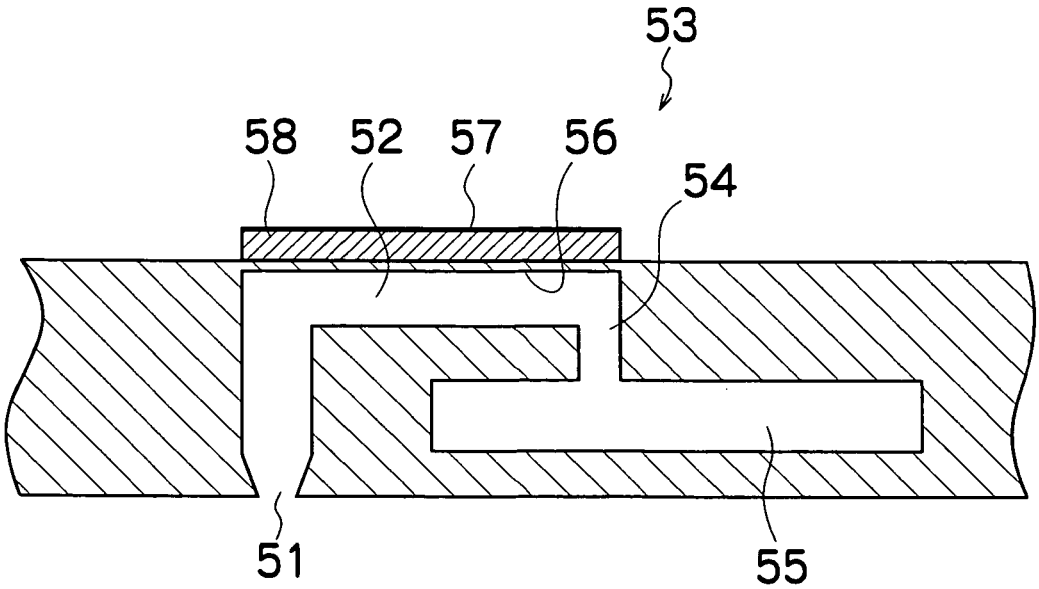
FIG. 4 is a cross-sectional diagram along line 4-4 in FIGS. 3A to 3C.

FIG. 3A is a plan view perspective diagram showing an example of the composition of a print head 50, and FIG. 3B is an enlarged diagram of a portion of same. Furthermore, FIG. 3C is a plan view perspective diagram showing a further example of the composition of a print head 50, and FIG. 4 is a cross-sectional diagram showing a three-dimensional composition of an ink chamber unit (being a cross-sectional view along line 4-4 in FIG. 3A). In order to achieve a high density of the dot pitch printed onto the surface of the recording paper 16, it is necessary to achieve a high density of the nozzle pitch in the print head 50. As shown in FIGS. 3A and 3B, the print head 50 according to the present embodiment has a structure in which a plurality of ink chamber units 53, each including a nozzle (ejection hole) 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced (high nozzle density is achieved).

The mode of forming one or more nozzle rows through a length corresponding to the entire width of the recording paper 16 in a direction substantially perpendicular to the conveyance direction of the recording paper 16 is not limited to the example described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

The pressure chamber 52 provided corresponding to each of the nozzles 51 is approximately square-shaped in plan view, and a nozzle 100 and a supply port 51 are provided respectively at either corner of a diagonal of the pressure chamber 52. Each pressure chamber 52 is connected via a supply port 54 to a common flow channel 55. The common flow channel 55 is connected to an ink tank (not shown in FIG. 4, but indicated by reference numeral 60 in FIG. 5), which is a base tank that supplies ink, and the ink supplied from the ink tank is delivered through the common flow channel 55 to the pressure chambers 52.

A piezoelectric element 58 provided with an individual electrode 57 is bonded to a pressure plate 56 which forms the upper face of the pressure chamber 52 and also serves as a common electrode, and the piezoelectric element 58 is deformed when a drive voltage is supplied to the individual electrode 57, thereby causing ink to be ejected from the nozzle 51. When ink is ejected, new ink is supplied to the pressure chamber 52 from the common flow passage 55, via the supply port 54.

On the other hand, if the pressure plate 56 receives pressure due to ejection or refilling of ink, or the like, then a distortion (stress) corresponding to this pressure is generated in the piezoelectric element 58, and a voltage corresponding to this distortion (pressure variation) is generated in the individual electrode 57.

In the inkjet recording apparatus 10, it is possible to determine a pressure (pressure wave) abnormality in a pressure chamber 52 by taking the voltage obtained from the piezoelectric element 58 (individual electrode 57) as a determination signal, and the presence and absence of an ejection abnormality in the nozzle 51 of the pressure chamber 52 can be determined on the basis of this pressure abnormality.

More specifically, the piezoelectric element 58 functions as an ejection force application device which causes ink to be ejected from the nozzle 51, as well as functioning as a determination device which determines pressure variations in the pressure chamber 52. The details of the control for determining an ejection abnormality on the basis of the pressure (pressure variation) in the pressure chamber 52 described above will be explained below.

In the present embodiment, a mode is described in which one piezoelectric element is used for applying ejection force to the ink inside the pressure chamber 52 and for determining the pressure of the pressure chamber 52. However, it is also possible to use separate piezoelectric elements to apply ejection force and to determine the pressure. Furthermore, it is also possible to use a pressure sensor other than a piezoelectric element.

In general, for application of an ejection force, it is desirable to use a piezoelectric element having large absolute values of the equivalent piezoelectric constants (d constant, electrical-mechanical conversion constant, piezoelectric strain constant) and excellent drive characteristics; and for pressure determination, it is desirable to use a piezoelectric element having large values for the piezoelectric output coefficients (g constant, mechanical-electrical conversion constant, piezoelectric stress constant) and excellent determination characteristics.

A ceramic material is suitable for a piezoelectric element having excellent driving characteristics, whereas on the other hand, a fluoride resin type material, such as polyvinylidene fluoride (PVDF) or polyvinylidene fluoride-ethylene trifluoride copolymer (PVDF-TrFE) is suitable for a piezoelectric element having excellent determination characteristics.

In a mode which uses separate piezoelectric elements for applying ejection force and for determining pressure, elements having excellent ejection characteristics and excellent determination characteristics should be used respectively for the piezoelectric elements. Furthermore, in this case, the respective piezoelectric elements may be provided on the same wall of the pressure chamber 52, or they may be provided on different walls.

On the other hand, in a mode which uses a single common piezoelectric element for applying ejection force to the ink and for determining the pressure in the pressure chamber, it is necessary to provide both the aforementioned drive characteristics and determination characteristics in the piezoelectric element. In the present embodiment, a piezoelectric element having increased determination characteristics is adopted, by altering the composition ratio of a ceramic type piezoelectric element having excellent ejection characteristics.

One example of a ceramic material is lead zirconate titanate ($Pb(Zr, Ti)O_3$), and taking lead titanate ($PbTiO_3$) which is a ferroelectric material, and lead zirconate ($PbZrO_3$) which is an antiferroelectric material to be the basic components, it is possible to control various properties of the ceramic material, such as the piezoelectric, dielectric and elastic characteristics, by changing the ratio in which these two components are combined, and hence a piezoelectric ceramic material having better ink ejection efficiency and pressure determination efficiency can be obtained.

As shown in FIG. 3B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is d×cos θ, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the example shown in the drawings, and it is also possible to apply various other types of nozzle arrangements, such as an arrangement structure having one nozzle row in the sub-scanning direction.

Configuration of Ink Supply System

Figure 5:
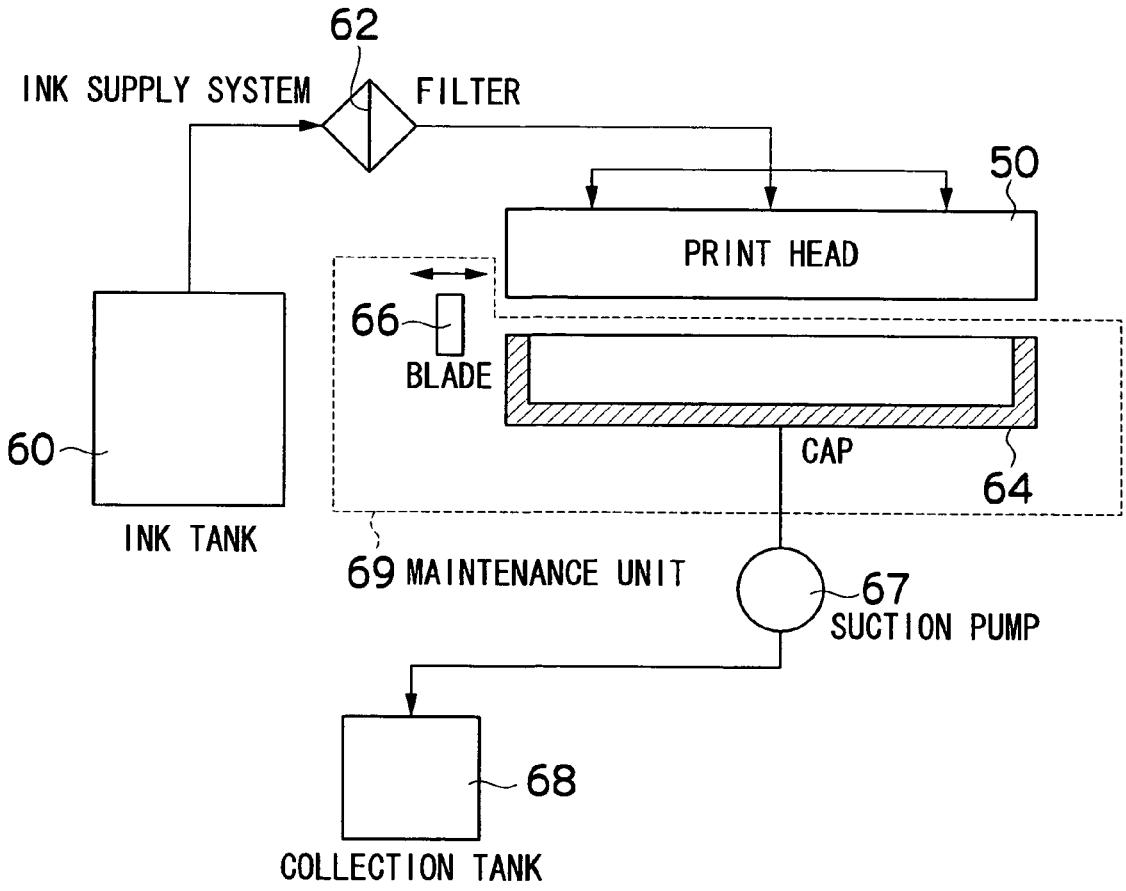
FIG. 5 is an approximate diagram showing the composition of an ink supply system in an inkjet recording apparatus according to the present embodiment.

FIG. 5 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 5 is equivalent to the ink storing and loading unit 14 in FIG. 1 described above.

A filter 62 for removing foreign matters and bubbles is disposed between the ink tank 60 and the print head 50 as shown in FIG. 5. The filter mesh size in the filter 62 is preferably equivalent to or less than the diameter of the nozzle and commonly about 20 μm. Although not shown in FIG. 5, it is preferable to provide a sub-tank integrally to the print head 50 or nearby the print head 50. The sub-tank has a damper function for preventing variation in the internal pressure of the head and a function for improving refilling of the print head.

Furthermore, the inkjet recording apparatus 10 is also provided with a maintenance unit 69 comprising a cap 64, being a device for preventing the nozzles 51 from drying out and preventing increase in the viscosity of the ink in the vicinity of the nozzles, and a cleaning blade 66 forming a device for cleaning the surface of the nozzles. The maintenance unit 69 including the cap 64, the cleaning blade 66, and the like, can be moved in a relative fashion with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink ejection surface of the print head 50 by means of a blade movement mechanism (not shown). When ink droplets or foreign matter has adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the print head 50 (inside the pressure chamber 52), the cap 64 is placed on the print head 50, the ink inside the pressure chamber 52 (the ink in which bubbles have become intermixed) is removed by suction with a suction pump 67, and the suction-removed ink is sent to a collection tank 68. This suction action entails the suctioning of degraded ink of which viscosity has increased (hardened) also when initially loaded into the print head 50, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the piezoelectric element 58 for the ejection driving is operated. Before reaching such a state (in a viscosity range that allows ejection by the operation of the piezoelectric element 58) the piezoelectric element 58 is operated to perform the preliminary discharge to eject the ink of which viscosity has increased in the vicinity of the nozzle toward the ink receptor. After the nozzle face is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, ink can no longer be ejected from the nozzle 51 even if the piezoelectric element 58 is operated. Also, when the ink viscosity inside the nozzle 51 has increased over a certain level, ink can no longer be ejected from the nozzle 51 even if the piezoelectric element 58 is operated. In these cases, a suctioning device to remove the ink inside the pressure chamber 52 by suction with a suction pump, or the like, is placed on the nozzle face of the print head 50, and the ink in which bubbles have become intermixed or the ink of which viscosity has increased is removed by suction.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

In the inkjet recording apparatus 10, an ejection abnormality determination function for determining an ejection abnormality in the nozzle 51 shown in FIG. 4 is provided, and a nozzle maintenance operation (nozzle restoration operation), such as preliminary ejection, suctioning, and the like, described above, is performed in respect of a nozzle 51 which is determined to have an ejection abnormality due to blocking of the nozzle 51 or intermixing of air bubbles into the pressure chamber 52.

Description of Control System

Figure 6:
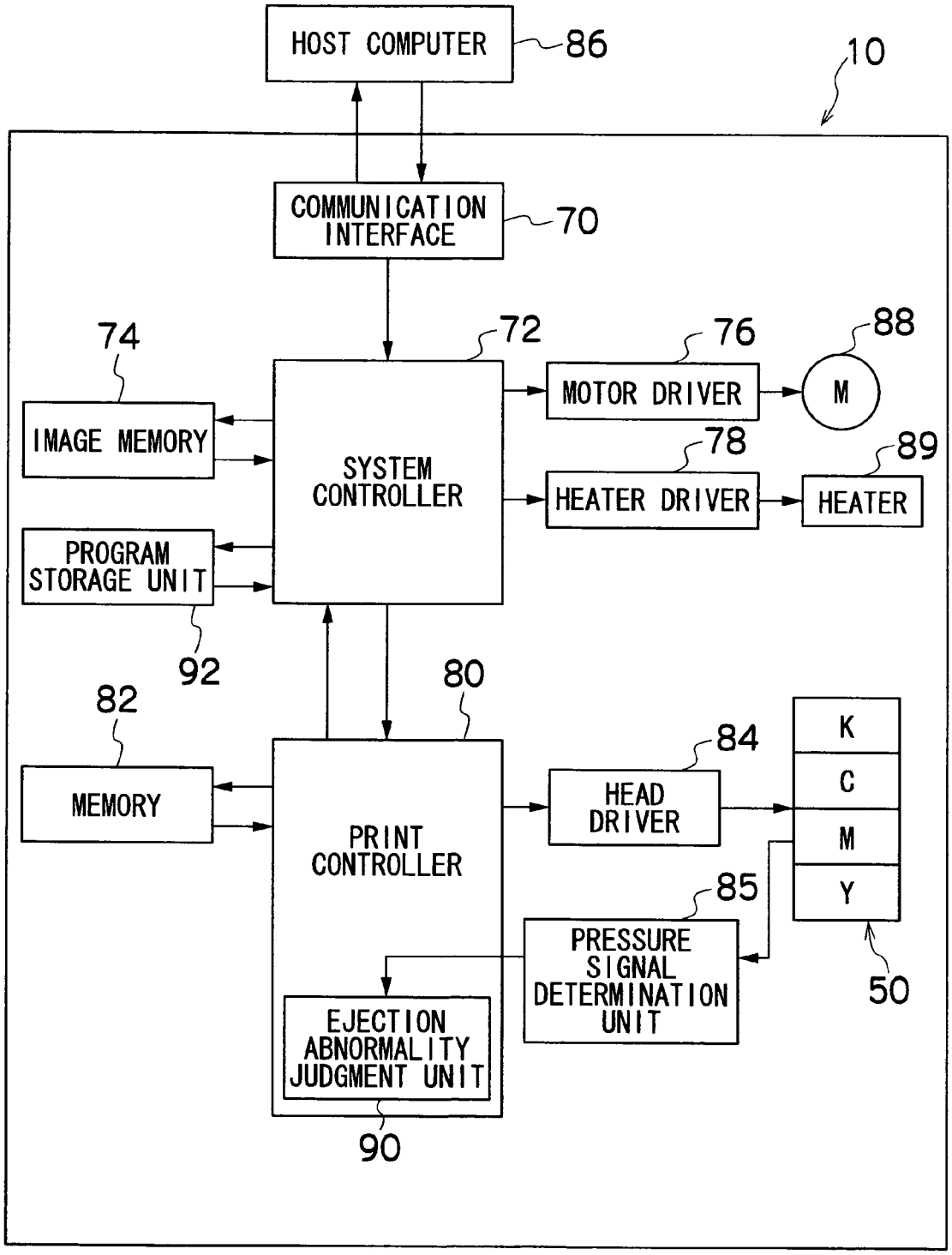
FIG. 6 is a principal block diagram showing the system configuration of the inkjet recording apparatus.

FIG. 6 is a principal block diagram showing the system composition of the inkjet recording apparatus 10. The inkjet recording apparatus 10 comprises a communications interface 70, a system controller 72, a memory 74, a motor driver 76, a heater driver 78, a print controller 80, a memory 82, a head driver 84, a pressure signal determination unit 85, and the like.

The communications interface 70 is an interface unit for receiving image data transmitted by a host computer 86. For the communications interface 70, a serial interface, such as USB, IEEE 1394, the Internet, or a wireless network, or the like, or a parallel interface, such as a Centronics interface, or the like, can be used. It is also possible to install a buffer memory (not shown) for achieving high-speed communications. Image data sent from a host computer 86 is read into the inkjet recording apparatus 10 via the communications interface 70, and it is stored temporarily in the memory 74.

The memory 74 is a storage device for temporarily storing an image input via the communications interface 70, and data is written to and read from the memory 74 via the system controller 72. The memory 74 is not limited to a memory composed of a semiconductor element, and a magnetic medium, such as a hard disk, or the like, may also be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, memory 74, motor driver 76, heater driver 78, and the like, as well as controlling communications with the host computer 86 and writing and reading to and from the memory 74, and it also generates control signals for controlling the motor 88 and heater 89 of the conveyance system.

The program executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The memory 82 is provided in the print controller 80, and image data, parameters, and other data are temporarily stored in the memory 82 when image data is processed in the print controller 80. Also possible is a mode in which the print controller 80 and the system controller 72 are integrated to form a single processor.

The head driver 84 drives the piezoelectric elements 58 of the heads of the respective colors 12K, 12C, 12M and 12Y on the basis of print data supplied by the print controller 80. The head driver 84 can be provided with a feedback control system for maintaining constant drive conditions for the print heads.

The image data to be printed is externally inputted through the communication interface 70, and is stored in the memory 74. In this stage, the RGB image data is stored in the memory 74.

The image data stored in the memory 74 is sent to the print controller 80 via the system controller 72, and is converted to dot data for each ink color by the print controller 80. In other words, the print controller 80 performs processing for converting the input RGB image data into dot data for four colors, K, C, M and Y. The dot data generated by the print controller 80 is stored in the memory 82.

The head driver 84 generates drive control signals for the print head 50 on the basis of the dot data stored in the memory 82. By supplying the drive control signals generated by the head driver 84 to the print head 50, ink is ejected from the print head 50. By controlling ink ejection from the print heads 50 in synchronization with the conveyance velocity of the recording paper 16, an image is formed on the recording paper 16.

The pressure signal determination unit 85 is a signal processing unit which carries out prescribed signal processing, such as noise elimination and amplification, on the voltage (determination signal) corresponding to the pressure variations in the pressure chamber 52 obtained from the piezoelectric element 58 shown in FIG. 4. The determination signal that has undergone signal processing by the pressure signal determination section 85 is sent to an ejection abnormality judgment unit 90 inside the print controller 80, and the presence or absence of an ink blockage in the nozzle 51 of the corresponding pressure chamber 52, or of an ejection abnormality caused by the occurrence of an air bubble, or the like, inside the pressure chamber 52, is determined. The details of the ejection abnormality judgment unit 90 are described hereinafter.

In this embodiment, the driving of ink ejection and the determination of the pressure in the pressure chamber 52 is performed by using a common piezoelectric element 58. Furthermore, the individual electrode 57 provided in the piezoelectric element 58 is not only applied with a drive signal for determination, but also reads out the determination signal obtained by pressure determination.

In other words, in the pressure signal determination unit 85, switching control is performed between the drive signal application circuit and the determination signal acquisition circuit, in such a manner that, at a timing when a drive signal is applied from the head driver 84 to the piezoelectric element 58, no determination signal is obtained, and at a timing when the drive signal is not applied (the interval period), a determination signal is obtained. A multiplexer circuit, or the like, should be used for the switching circuit.

Furthermore, the individual electrode 57 is connected to the head driver 84 and the pressure signal determination unit 85 via a common signal wire (not shown). There is also a mode in which a flexible substrate is used for wiring from the print head 50, including the aforementioned common signal wire, and the like, to the control system.

Here, the flexible substrate used for the signal wire is illustrated as being made of copper wiring, or the like, formed on a resin sheet or polyimide, or the like. The wiring may be formed on either the front surface or the rear surface of the resin sheet, or it may be formed on both the front and rear surfaces thereof.

Various control programs are stored in a program storage unit 92, and a control program is read out and executed in accordance with commands from the system controller 72. The program storage unit 92 may use a semiconductor memory, such as a ROM, EEPROM, or a magnetic disk, or the like. An external interface may be provided, and a memory card or PC card may also be used. Naturally, a plurality of these storage media may also be provided.

The program storage unit 92 may also be combined with a storage device for storing operational parameters, and the like (not shown).

Determination of Ejection Abnormalities

Next, ejection abnormality determination according to the present embodiment will be described in detail.

The ejection abnormality determination according to the present embodiment judges the presence or absence of ejection abnormalities in the nozzles 51 on the basis of an integrated value obtained by integrating the determination signal (output charge) obtained from the piezoelectric element 58 for a prescribed integration time.

Figure 7A:
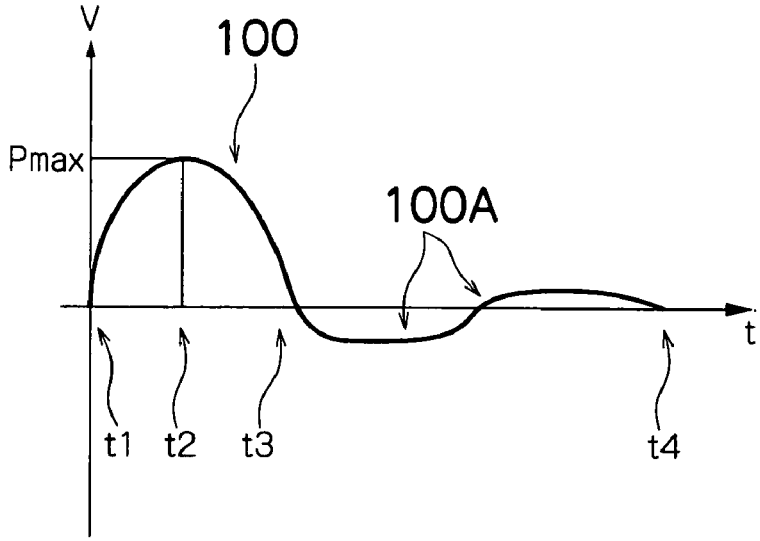
FIG. 7A and FIG. 7B are diagrams showing a determination signal in the case of normal ejection and the integrated value of the determination signal.

FIG. 7A shows a determination signal 100 (pressure waveform) in a case where ink is ejected normally from a nozzle 51. The determination signal 100 has a voltage which is directly proportional to the amplitude of the pressure wave in the pressure chamber 52, and the voltage waveform of the determination signal 100 is similar to the pressure waveform of the pressure wave.

In FIG. 7A, the horizontal axis indicates time t, and the vertical axis indicates voltage V; the positive direction of the horizontal axis is the direction in which the volume of the pressure chamber 52 contracts (the ejection direction, in other words, the meniscus pushing direction), and the negative direction in which the volume of the pressure chamber 52 expands (the direction opposite to the ejection direction, in other words, the meniscus pulling direction).

When a prescribed drive signal is applied to the piezoelectric element 58 at timing t1, and the piezoelectric element 58 is operated, the pressure of the pressure chamber 52 (the pressure applied to the ink inside the pressure chamber 52) increases in accordance with the increase in the amount of displacement of the piezoelectric element 58, and at timing t2, the displacement of the piezoelectric element 58 becomes a maximum, the pressure in the pressure chamber 52 assumes a maximum value Pmax, and at this timing (or in the vicinity of this timing), ink is ejected from the nozzle 51.

From timing t2 until the drive signal end timing t3, the piezoelectric element 58 is displaced in the opposite direction to the ejection direction (the amount of displacement decreases from the state of maximum displacement). In combination with this, the pressure of the pressure chamber 52 gradually declines and at timing t3, the piezoelectric element 58 returns to a static state where the amount of displacement is substantially the same at that at timing t1, and the pressure of the pressure chamber 52 becomes substantially the same as the pressure at the start of application of the drive signal (timing t1). The time period for which the drive signal is applied to the piezoelectric element 58 is the time period from timing t1 until timing t3.

Furthermore, between the drive signal end timing t3 and the timing t4, residual vibration 100A (residual vibration in the pressure wave, hereinafter, simply called "residual vibration") due to transient phenomena occurs in the pressure wave of the pressure chamber 52 and this residual vibration 100A is restricted and converges at timing t4. In other words, timing t4 is the convergence timing of the residual vibration 100A.

The time period from timing t3 to timing t4 is a time period which is longer than half of the resonance period of the ejection system of the print head 50, and in this embodiment, a mode is shown in which the residual vibration period is double the half-period of the resonance. Naturally, there may also be cases where no residual vibration 100A occurs, cases where the residual vibration period is substantially the same as the half-period of the resonance (½ period), or cases where it is equal to or greater than double the half-period of the resonance.

The half-period of the resonance in the present embodiment corresponds to the period from timing t1 until timing t3 shown in FIG. 7A.

If there is residual vibration 100A as shown in FIG. 7A, then it is not possible to eject ink during the time period that the residual vibration 100A occurs, and this impedes the achievement of high ejection frequency. In order to resolve this problem, the structure and size of the liquid ejection system (liquid flow channels) of the print head 50 including the nozzles 51, pressure chambers 52 and ink supply ports 54, and the waveform of the drive signal which drives the piezoelectric elements 58 are specified in such a manner that even if residual vibration 100A occurs, this residual vibration 100A is suppressed within a short time period (for example, within approximately double the half-period of the resonance shown in FIG. 7A).

More specifically, if ink ejection is performed normally from the nozzle 51, then the residual vibration 100A is suppressed within a short time period in such a manner that ink ejection can be performed continuously at high speed from the same nozzle.

The actual determination signal 100 is affected by the various clocks inside the apparatus and the characteristics of the commercial power supply, and is therefore superimposed with noise containing various frequency components. However, these noise components are not depicted in the waveform of the determination signal 100 shown in FIG. 7A.

Figure 7B:
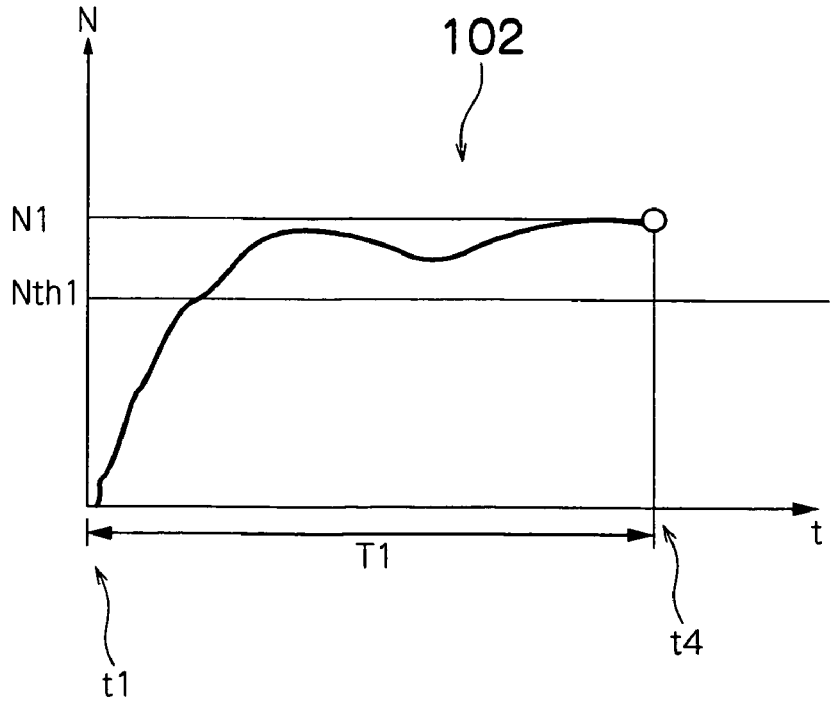

FIG. 7B shows an integrated value curve 102 indicating the integrated value N of the determination signal 100 shown in FIG. 7A, during the integration time period (the first integration time period) T1 from the drive signal application start timing t1 and the residual vibration convergence timing t4. In FIG. 7B, the horizontal axis indicates the time t and the vertical axis indicates the integrated value N.

As shown in FIG. 7B, the integrated value curve 102 when ink is normally ejected from the nozzle 51 tends to increase in the time period from the drive signal application start timing t1 until the drive signal end timing t3. During the time period where the residual vibration 100A has an amplitude in the negative direction, the curve 102 decreases temporarily, and during the time period where the residual vibration 100A has an amplitude in the positive direction, it tends to increase again. When the residual vibration 100A has been suppressed, the curve 102 tends to maintain a constant and unchanging value.

If there is no residual vibration, then the integrated value curve 102 will be the a curve without any period of decrease.

In other words, at timing t4, the integrated value of the determination signal 100 (the first integrated value) N1 is determined for the first integration time period T1 from the drive signal application start timing t1 until the timing t4 at which the residual vibration 100A is suppressed, and if the relationship between the first integrated value N1 thus determined and a previously established first threshold value Nth1 satisfies Nth1<N1, then it can be judged that the nozzle 51 is normal.

The first integrated value N1 in the integration time period T1 can be found by integrating the determination signal 100 for the first integration time period T1.

On the other hand, if the relationship between the first threshold value Nth1 and the first integration value N1 satisfies Nth1≧N1, then it can be judged that an ejection abnormality has occurred in that nozzle.

This occurs because the resonance frequency changes when an ejection abnormality occurs in the nozzle 51, and therefore, the behavior of the pressure wave (the pressure waveform) changes, and the integrated value N of the determination signal 100 in the first integration time period T1 declines.

Next, the determination signal in the event of an ejection abnormality, and the integrated value curve showing the integrated value N of the determination signal, will be described.

Figure 8A:
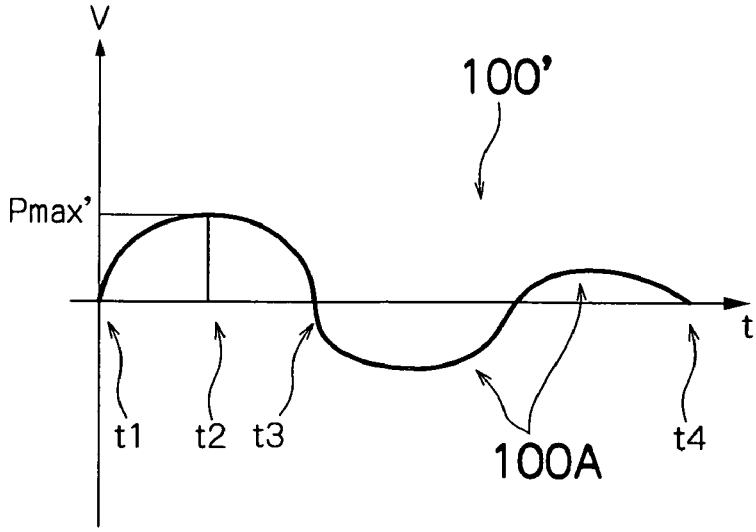
FIG. 8A and FIG. 8B are diagrams showing one example a determination signal in the case of an ejection abnormality and the integrated value of the determination signal.
Figure 8B:
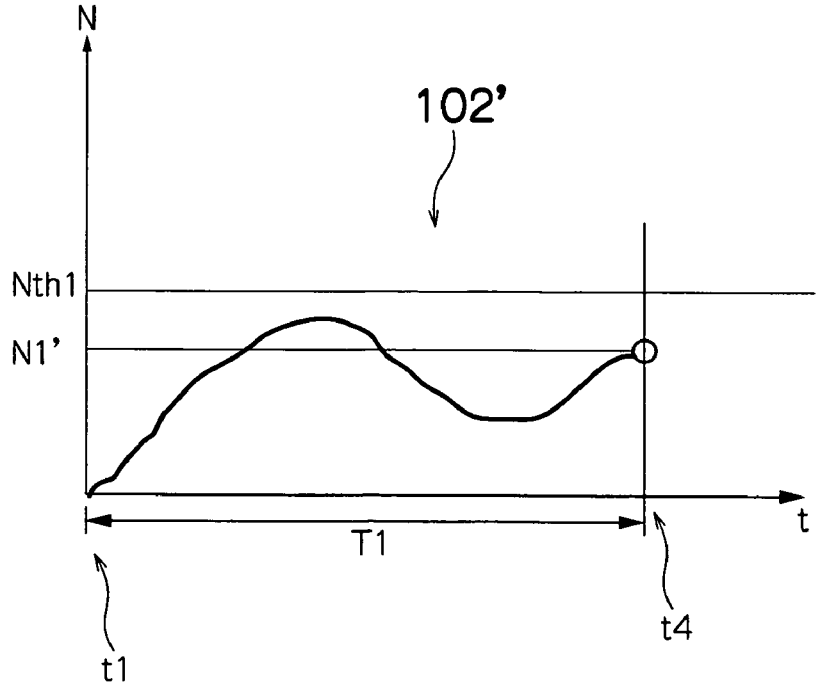

FIG. 8A shows a determination signal 100' in a case where an air bubble has occurred inside the pressure chamber 52, and FIG. 8B shows an integrated value curve 102' showing the integrated value of the determination signal 100' shown in FIG. 8A. In FIGS. 8A and 8B, items which are the same as or similar to those in FIGS. 7A and 7B are labeled with the same reference numerals and description thereof is omitted here.

If an air bubble arises inside the pressure chamber 52 due to introduction of gas from the exterior via the nozzle 51, or due to evaporation of dissolved gas as a result of temperature change in the ink inside the pressure chamber 52, then an ejection abnormality (ejection failure, reduction in ejection volume) occurs due to loss of the ejection force applied by the piezoelectric element 58.

More specifically, as shown in FIG. 8A, if an air bubble occurs in the pressure chamber 52, the maximum value of the pressure wave (maximum amplitude) Pmax' is smaller than the maximum value Pmax of the pressure wave during normal ejection, and the maximum value Pmax of the pressure wave during normal ejection and the maximum value Pmax' of the pressure wave in the case of an ejection abnormality due to the occurrence of an air bubble inside the pressure chamber 52 satisfy Pmax>Pmax'.

Furthermore, since the resonance frequency changes, residual vibration 100A' having a larger amplitude than that during normal ejection shown in FIG. 8A is generated in the pressure wave. This phenomenon causes a decline in the integrated value N, when the integrated value N (=N1) of the determination signal 100' is determined for the integration time period T1.

Therefore, the relationship between the first integrated value N1' for the first integration time period T1 and the first threshold value Nth1 is Nth1≧N1', and thus the relationship between these two values satisfies the above-described relationship Nth1≧N1 between the first threshold value Nth1 and the first integrated value N1 for the first integration time period T1.

When the ejection abnormality determination method described above is used, it is possible to determine the presence or absence of an ejection abnormality in a case where an air bubble has occurred inside the nozzle 51 or where an air bubble has occurred inside both the nozzle 51 and the pressure chamber 52.

Figure 9A:
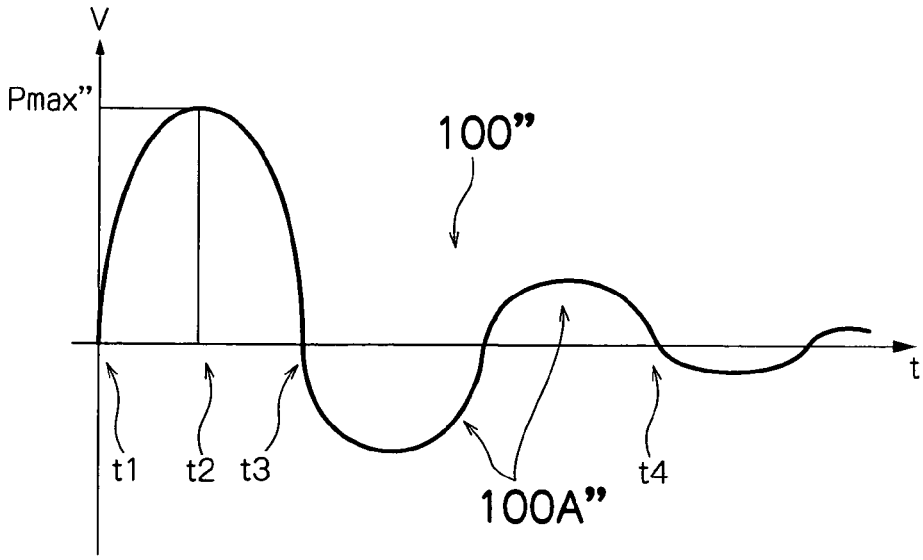
FIG. 9A and FIG. 9B are diagrams showing a further example of the determination signal in the case of an ejection abnormality shown in FIGS. 8A and 8B, and the integrated value of the determination signal.
Figure 9B:
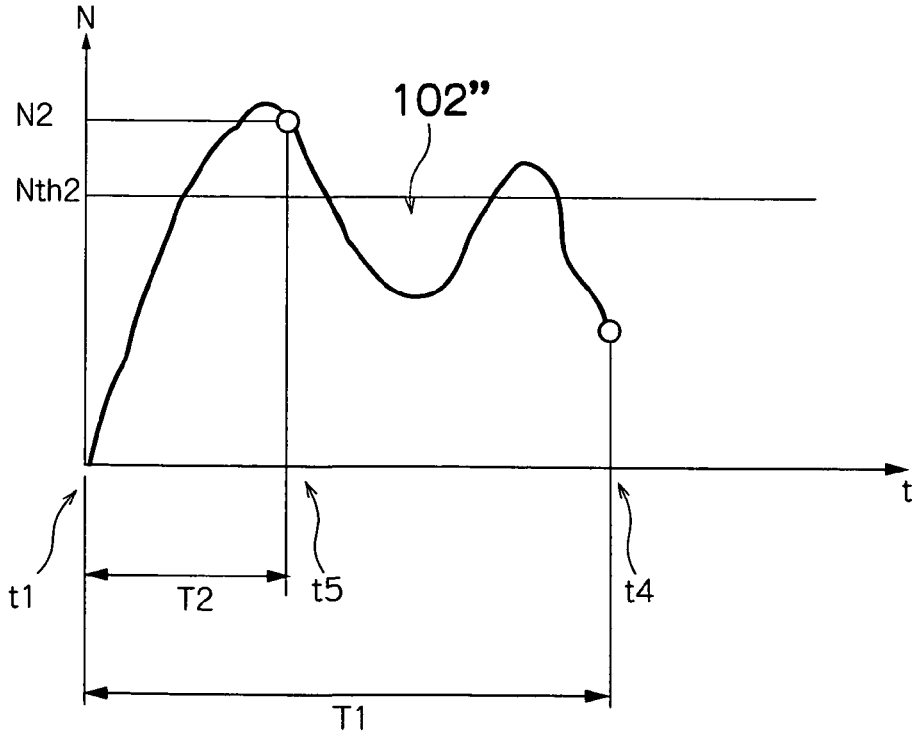

FIG. 9A shows a determination signal 100" in a case where an ejection abnormality has occurred due to a nozzle blockage caused by ink blocking up the nozzle 51 as a result of drying of the ink in the vicinity of the meniscus or increased viscosity of the ink inside the nozzle 51. FIG. 9B shows an integrated value curve 102" indicating the integrated value N of the determination signal 100" shown in FIG. 9A.

When an ejection abnormality occurs in the nozzle 51 due to a nozzle blockage, since the pressure chamber 52 has a closed shape, the maximum value of the pressure wave during the time period of application of the drive signal (determination signal 100") is greater than that during normal ejection. More specifically, the relationship between the maximum value Pmax of the determination signal 100 during the time period of application of the drive signal during normal ejection and the maximum value Pmax" of the determination signal 100" during the time period of application of the drive signal in the case of an ejection abnormality due to a nozzle blockage will be Pmax<Pmax".

Furthermore, if an ejection abnormality occurs in the nozzle 51 due to an ink blockage, then the resonance frequency changes, and the residual vibration 100A" is not suppressed within the residual vibration time period in which the residual vibration is suppressed during normal ejection, but rather, the residual vibration time period is longer in the case of an ejection abnormality than it is in the case of normal ejection. Moreover, a phenomenon of increased amplitude of the residual vibration also occurs.

Consequently, if an ejection abnormality occurs due to a nozzle blockage, then the second integrated value N2 at the timing at which the integrated value curve 102" reaches a maximum during the time period of application of the drive signal (or a timing in the vicinity thereof) t5 (more specifically, the second integrated value N2 for the second integration time period T2) will be greater than the previously established second threshold value Nth2, and these two values will satisfy Nth2<N2.

Here, desirably, the timing t5 is the timing at which the pressure wave becomes a maximum value Pmax", or a timing after this. If the timing t5 is a timing before the time at which the pressure wave becomes a maximum value Pmax", it should be a timing near to the time at which the pressure wave becomes a maximum value Pmax".

The first threshold value Nth1 and the second threshold value Nth2 have the relationship of Nth1<Nth2.

Furthermore, the first integration time period T1 and the second integration time period T2 have the relationship of T1>T2.

FIGS. 9A and 9B show a case where the start timings of the first integration time period T1 and the second integration time period T2 are a common timing (t1), but it is also possible for the start timing of the first integration time period and the start timing of the second integration time period to be different timings. However, by setting the start timing of the first integration time period and the start timing of the second integration time period to a common timing, it is possible to unify a portion of the processing unit and algorithm which calculate the first integrated value N1 and the processing unit and algorithm which calculate the second integrated value N2.

The first integration time period T1 and the second integration time period T2 for calculating the first integrated value N1 and the second integrated value N2 are determined in accordance with the control of ink ejection. If the waveform of the drive signal supplied to the piezoelectric element 58 changes, then the pressure applied to the pressure chamber 52 changes, and the maximum values of the pressure generated in the pressure chamber 52 (Pmax, Pmax', Pmax") and the waveforms of the residual vibrations 100A, 100A' and 100A" will also change.

Consequently, the first integration time period T1 and the second integration time period T2 are specified in accordance with the waveform of the drive signal supplied to the piezoelectric element 58. For example, there is a mode in which the relationship between the waveform of the drive signal and the first integration time period T1 and the second integration time period T2 is previously recorded in the form of a data table, and when a drive signal is generated from the image data, a first integration time period T1 and a second integration time period T2 corresponding to this drive signal are read out from the data table (integration time period control table).

Similarly, the first threshold value Nth1 and the second threshold value Nth2 for determining an ejection abnormality in the nozzle 51 are also specified in accordance with the waveform of the drive signal. When a drive signal is generated, the first threshold value Nth1 and the second threshold value Nth2 are specified by referring to a previously recorded threshold value control table.

Of course, the first integration time period T1, the second integration time period T2, the first threshold value Nth1 and the second threshold value Nth2 may be derived by calculation on the basis of the waveform h of the drive signal.

Next, the composition of the ejection abnormality judgment unit 90 shown in FIG. 6 will be described.

Figure 10:
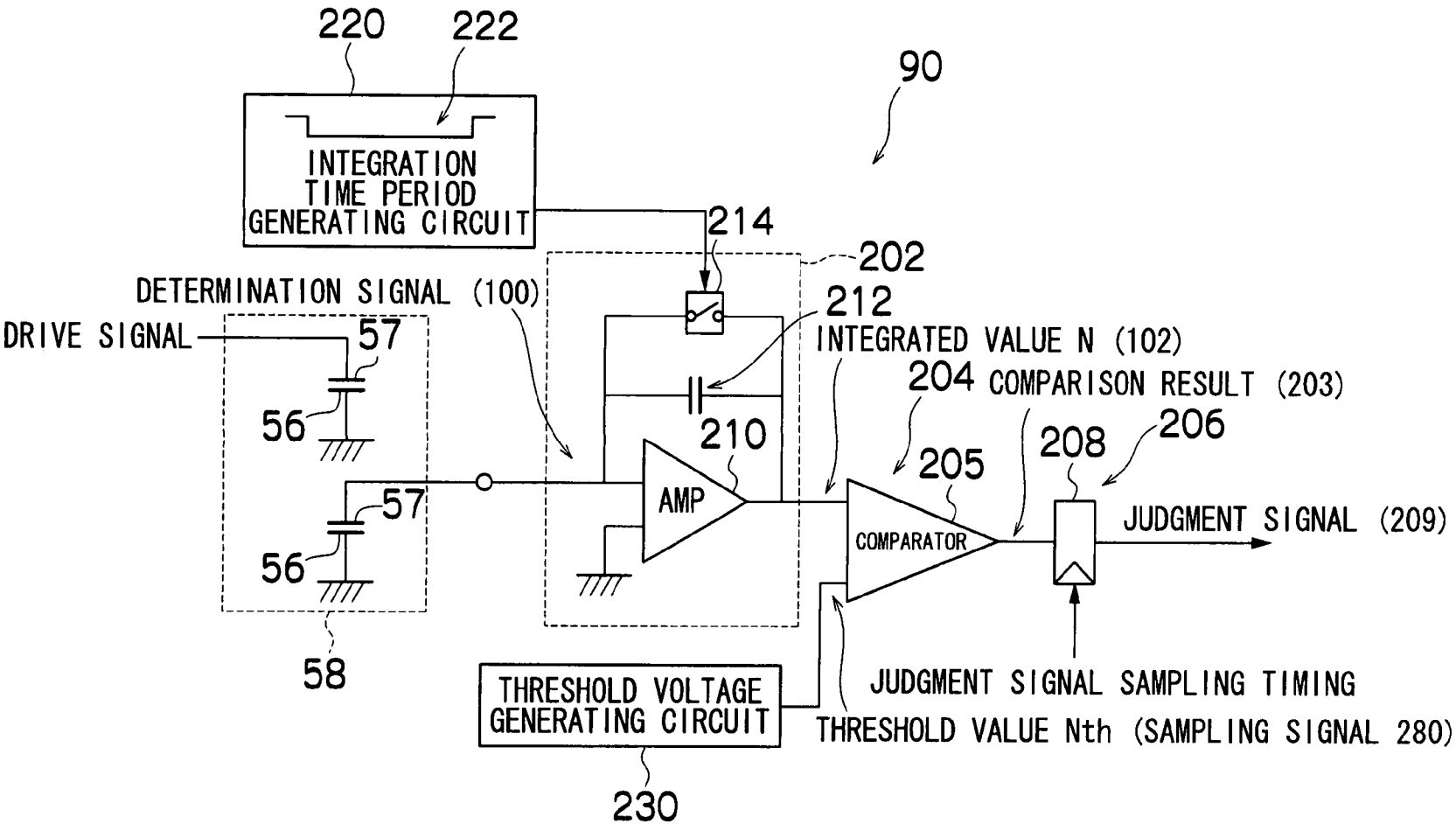
FIG. 10 is a principal block diagram showing the basic composition of an ejection abnormality judgment unit.

FIG. 10 is a diagram showing the basic principles (basic composition) for determining an ejection abnormality in a nozzle on the basis of an integrated value N derived for the determination signals 100, 100' and 100" shown in FIG. 7A, FIG. 8A and FIG. 9A (hereafter, described as determination signal 100 and so on).

The ejection abnormality judgment unit 90 shown in FIG. 10 comprises an integration unit 202, a comparison unit 204, a judgment unit 206, and the like. FIG. 10 does not depict the pressure signal determination unit 85 shown in FIG. 6, which is provided between the piezoelectric element 58 and the ejection abnormality judgment unit 90.

Moreover, in the ejection abnormality determination employed in the present inkjet recording apparatus 10, two integrated values N are determined on the basis of two integration time periods and the presence or absence of an ejection abnormality is judged by comparing these values with two threshold values Nth1 and Nth2. However, FIG. 10 shows the essential composition of an ejection abnormality judgment unit 90 which judges an ejection abnormality on the basis of the integrated value N for a determination signal, using one threshold value.

In FIG. 10, the piezoelectric element for applying an ejection force to the ink and the piezoelectric element for determining the pressure of the pressure chamber 52 are depicted as separate elements, but in the present embodiment, the application of an ejection force to the ink and the determination of the pressure in the pressure chamber 52 is performed by one piezoelectric element 58.

As shown in FIG. 10, the integration unit 202 which calculates the integrated value N of the determination signal 100, and so on, comprises an amplifier 210, a condenser 212 and a switch circuit 214. An integration time period signal 222 generated by an integration time period generating circuit 220 functions as a control signal which controls the on and off switching of the switch circuit 214. In the period when the integration time period signal 222 is at level L, the switch circuit 214 turns off (to a non-conducting state), and the determination signal output by the piezoelectric element 58 is integrated. On the other hand, in the period when the integration time period signal 222 is at level H, the switch circuit 214 turns on (to a conducting state) and the determination signal 100, and so on, obtained from the piezoelectric element 58 are not integrated.

The integrated value N determined by integrating the determination signal 100, and so on, is compared with a threshold value Nth (for example, the first threshold value Nth1 or the second threshold value Nth2 shown in FIGS. 7A and 7B) generated by a threshold voltage generating circuit 230, in the comparison unit 204 which is provided subsequently to the integration unit 202. The result of this comparison can be obtained as a comparison result (comparison result data) 203 from the comparison unit 204. In the present embodiment, the comparison unit 204 is constituted by a comparator 205 and peripheral circuitry (not shown).

Instead of or in combination with the integration time period generating circuit 220 and the threshold voltage generating circuit 230, it is also possible to provide a data table storage unit which stores integration time period data tables and threshold value data tables. Of course, this data table storage unit may be combined with the various types of memories and recording units provided in the inkjet recording apparatus 10.

The comparison result 203 is recorded temporarily in a comparison result recording unit 208 provided in the judgment unit 206, and the comparison result 203 recorded in the comparison result recording unit 208 is sampled at a prescribed sampling timing (in accordance with a sampling signal 280 which indicates a judgment signal sampling timing), and a judgment signal 209 indicating the presence or absence of an ejection abnormality is generated. For example, when sampling the comparison result between the integrated value N and the first threshold value Nth, the end timing t4 of the first integrated value T1 is used as the sampling timing.

Figure 11:
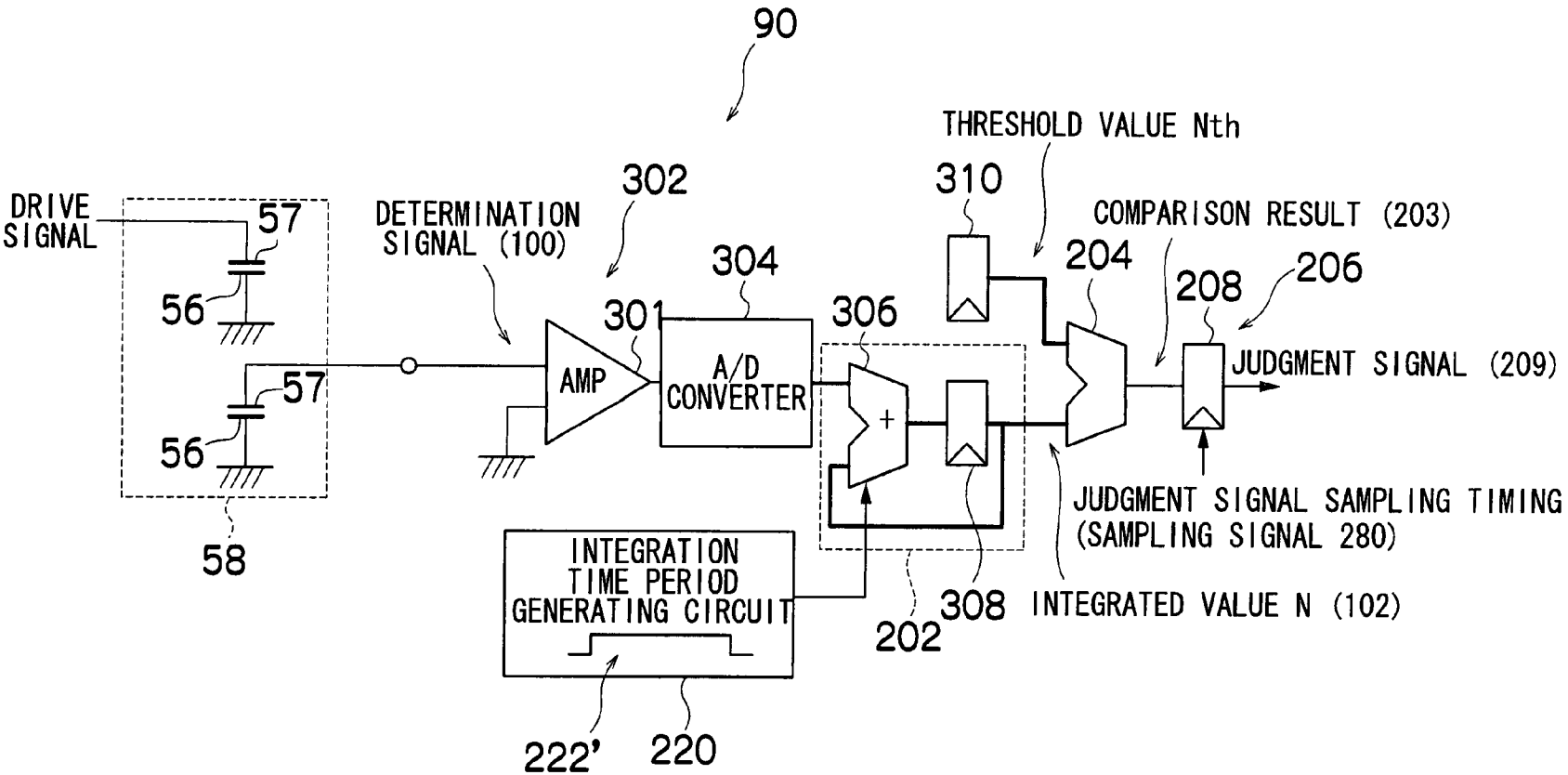
FIG. 11 is a principal block diagram showing a further mode of the basic composition of the ejection abnormality judgment unit shown in FIG. 10.

FIG. 11 shows a further mode of the basic composition of the ejection abnormality judgment unit 90 shown in FIG. 10. In FIG. 11, items which are the same as or similar to those in FIG. 10 are labeled with the same reference numerals and description thereof is omitted here.

In the mode shown in FIG. 11, the ejection abnormality judgment unit 90 comprises: a level shift unit 302 having an amplifier 301 which converts (amplifies) the determination signal to a prescribed voltage level; an A/D conversion unit (A/D converter) 304 which digitalizes the determination signal that has been level-shifted by the level shift unit 302; an integration unit 202 comprising an adder (adding circuit) 306 which adds up the digitalized determination signal, and an integration value register 308 which temporarily records the calculation result (integrated value N) of the adder 306; a comparison unit 204 which reads out the integrated value N recorded in the integrated value register 308 and compares the integrated value N with a threshold value (first threshold value Nth1 or second threshold value Nth2) recorded in the threshold value register 310; and a judgment unit 206, comprising a comparison result recording unit (comparison result register) 208 for recording comparison results 203 supplied by the comparison unit 204, which determines the presence or absence of an ejection abnormality in the nozzle 51 on the basis of the comparison results 203 read out from the comparison result recording unit 208 at a prescribed sampling timing (on the basis of a sampling signal 280 which indicates the judgment signal sampling timing).

An integration time period signal 222' of opposite phase to the integration time period 222 shown in FIG. 10 is generated by the integration time period generating circuit 220 and supplied to the integration unit 202. Of course, the mode shown in FIG. 10 (integration time period signal 222) or the mode shown in FIG. 11 (integration time period signal 222') may be adopted for the integration time period signal, in accordance with the composition of the circuitry which supplies this integration time period signal.

FIG. 10 shows a mode where the ejection abnormality judgment unit 90 is constituted principally by analogue circuitry and FIG. 11 shows a mode where the ejection abnormality judgment unit 90 is constituted principally by digital circuitry. A desirable mode is one in which a protection circuit, or the like, for protecting the low-pass filter circuit, the input section, and the like, from surges, etc., is provided in the signal input section (not shown) of the ejection abnormality judgment unit 90 shown in FIG. 10 and FIG. 11.

Figure 12:
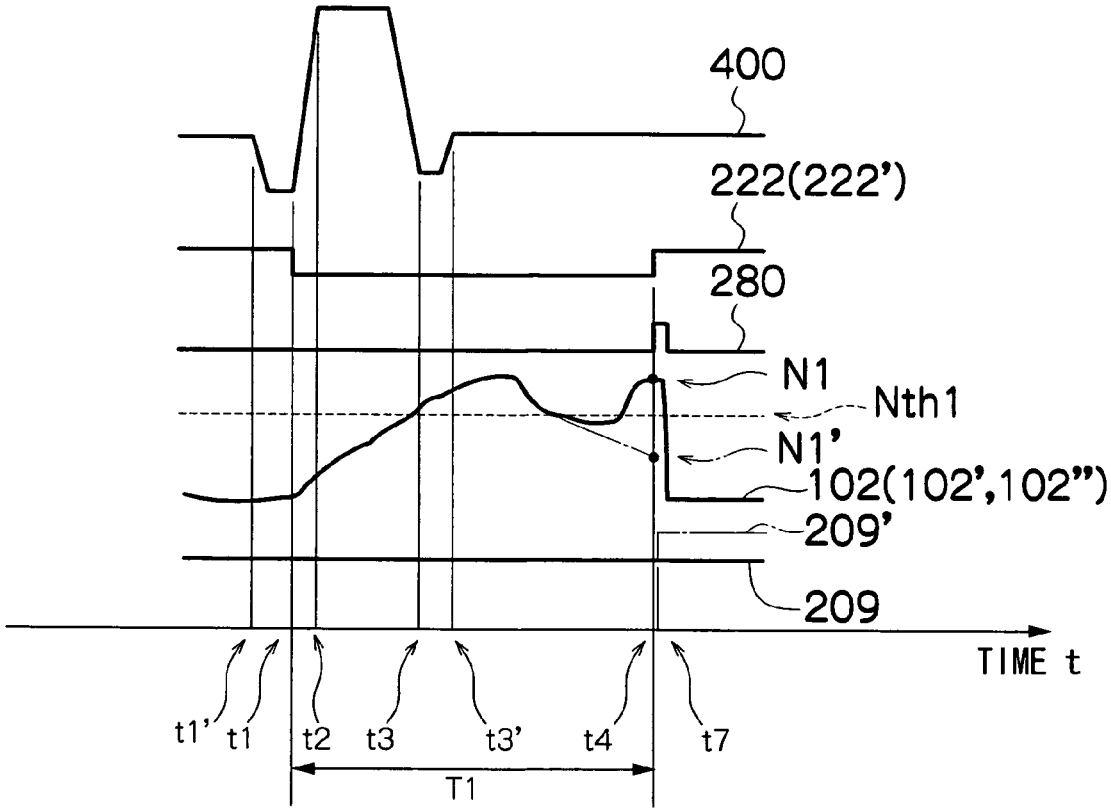
FIG. 12 is a diagram showing the relationship between the respective signals in the ejection abnormality judgment shown in FIGS. 10 and 11.

FIG. 12 shows the timings of the respective signals in the ejection abnormality judgment unit 90 shown in FIG. 10 and FIG. 11.

The signal indicated by reference numeral 400 in FIG. 12 is the drive signal of the piezoelectric element 58, and when a drive signal 400 is applied to the piezoelectric element 58, in response to this drive signal 400, then the piezoelectric element 58 performs a pull-push operation, comprising a pull action between timing t1' and timing t1, a push action between timing t1 and timing t3, and a further pull action between timing t3 and timing t3'.

In the integration time period generating circuit 220 shown in FIG. 10 and FIG. 11, the integration time period T1 is specified in accordance with the drive signal 400 and an integration time period signal 222 is generated accordingly. The integration time period T1 may be set to the combined time period of the time period of application of the drive signal from the timing t1' at which the drive signal 400 is applied to the piezoelectric element 58 until the drive signal end timing t3', and the residual vibration time period from the drive signal end timing t3' until the residual vibration convergence timing t4, or alternatively, it may be set to the combined time period of the time period during which the piezoelectric element 58 performs a push action, from timing t1 at which the piezoelectric element 58 starts to operate from its static state in the ejection direction until timing t3 when it returns to a static state (in other words, the time period from the operation of the piezoelectric element 58 in the ejection direction until its return to a static state), and the time period from timing t3 at which the piezoelectric element 58 returns to a static state until the residual vibration convergence timing t4.

FIG. 12 shows a mode in which the integration time period T1 is set to the time period from timing t1 until the timing t4.

Furthermore, the signal indicated by reference numeral 280 is a sampling signal which supplies a judgment signal sampling timing to the comparison result recording unit 208 shown in FIG. 10 (a first sampling timing signal). This signal is used to sample the comparison result 203 from the comparison result recording unit 208.

In the present embodiment, a sampling signal 402 is used which has a leading edge at substantially the same timing as the final edge of the integration time period signal 222 (the trailing edge of the integration time period signal, or in other words, timing t4).

The sampling signal 280 shown in the present embodiment uses a positive logic pulse signal in which the rising edge is the leading edge, but of course, it is also possible to use a negative logic pulse signal in which the falling edge is the leading edge.

The comparison result 203 recorded in the comparison result recording unit 208 shown in FIG. 10 and FIG. 11 is sampled at the judgment signal sampling timing t4, thereby yielding a judgment signal 209 (209'). In the present embodiment, the integrated value N1 at the judgment signal sampling timing t4 of the integrated value curve 102 indicated by the solid line in FIGS. 8A and 8B is a larger value than the threshold value Nth1, and therefore it is judged that the nozzle 51 is in a normal ejection state and a judgment signal 209 indicating a normal state, as depicted by the solid line, can be obtained at the prescribed timing t7.

On the other hand, as also shown in FIGS. 8A and 8B, the integrated value N1' at the judgment signal sampling timing t4 of the integrated value curve 102' indicated by the single-dotted line in FIG. 12 is a smaller value than the threshold value Nth, and therefore, it is judged that an ejection abnormality has occurred in the nozzle 51 and a judgment signal 209' indicating an ejection abnormality state as shown in by the single-dotted line can be obtained at the prescribed timing t7.

When the judgment signal 209 (209') is obtained at timing t7, the integrated value N1 (the comparison result 203 recorded in the comparison result recording unit 208) is reset at a prescribed timing after timing t7.

The judgment signal 209 (209') shown in the present embodiment indicates a normal state when it is at level L (depicted by a solid line in the drawings), and it indicates an ejection abnormality state when it is at level H (depicted by a single-dotted line). Of course, the reverse logic to this may also be used. Furthermore, the output timing t7 of the judgment signal 209 shown in the present embodiment is a timing which is delayed by a prescribed time period from the judgment signal sampling timing t4. This delay time may also be set to zero (in other words, the judgment signal 209 may be output at substantially the same time as the judgment signal sampling timing t4). In order to ensure the reliability of the judgment signal 209, a desirable mode is one in which the delay time is several times larger than the process clock (the clock of the ejection abnormality determination process).

Figure 13:
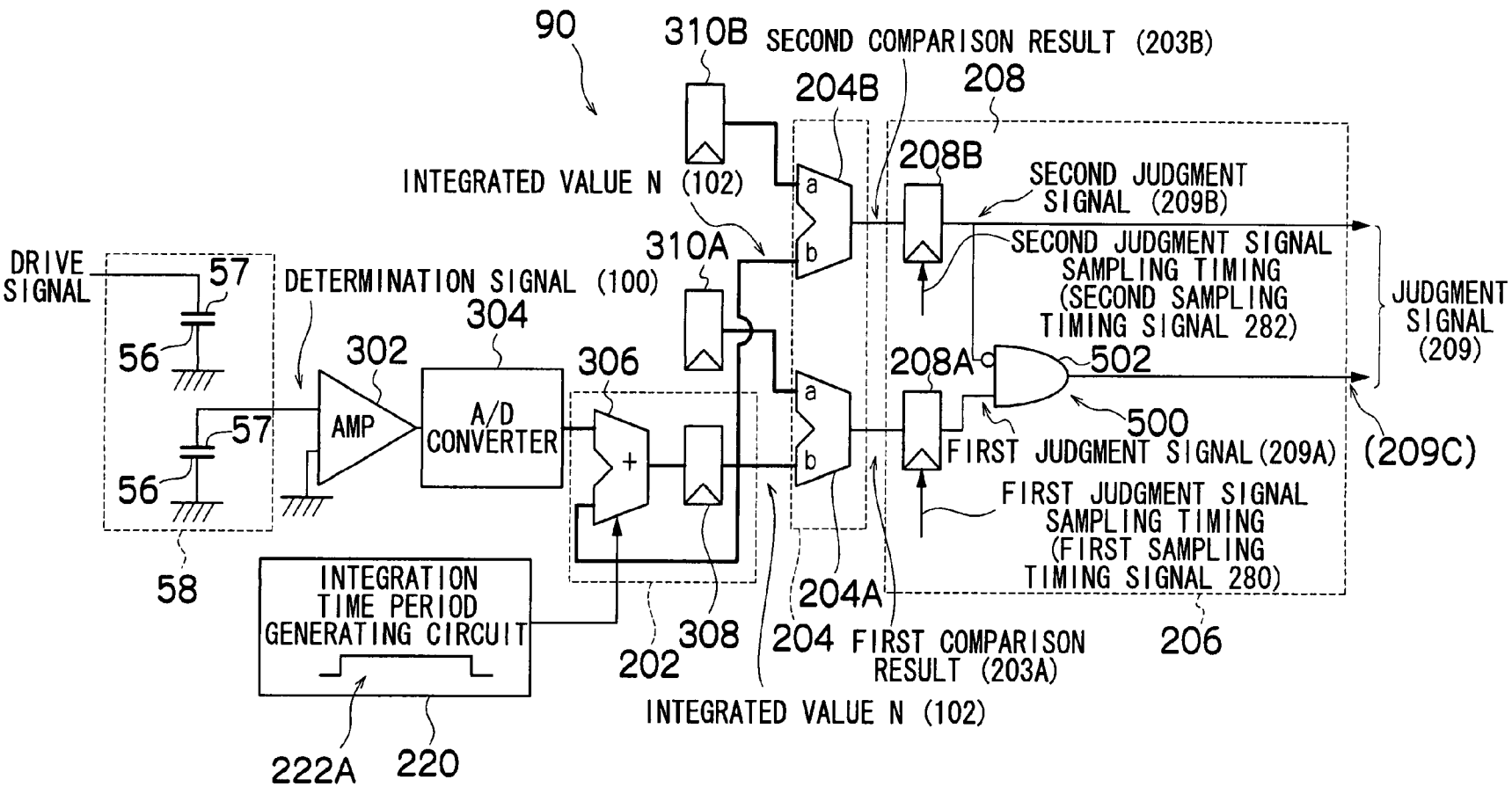
FIG. 13 is a principal block diagram showing the general composition of an ejection abnormality judgment unit.

FIG. 13 shows the composition of the ejection abnormality judgment unit 90 according to the present embodiment. In FIG. 13, items which are the same as or similar to those in FIG. 11 are labeled with the same reference numerals and description thereof is omitted here.

In the ejection abnormality judgment unit 90 shown in FIG. 13, the comparison unit 204 comprises a first comparator 204A and a second comparator 204B. A first comparison result register 310A for recording a first threshold value Nth1 used in the first comparator 204A, and a second comparison result register 310B for recording a second threshold value Nth2 used in the second comparator 204B are provided.

Furthermore, the judgment unit 206 comprises a first comparison result register 208A which records a first comparison result 203A supplied by the first comparator 204A; a second comparison result register 208B which records a second comparison result 203B supplied by the second comparator 204B; and a judgment signal generating unit 500 which generates a 2-bit judgment signal 209 comprising first and second judgment signals 209A and 209B from the first and second comparison results 203A and 203B recorded in the first comparison result register 208A and the second comparison result register 208B.

In the mode shown in FIG. 13, the integration time period generating circuit 220 supplies a common integration time period signal 222A to the integration unit 202 in respect of the first integration time period T1 and the second integration time period T2. The integration unit 202 determines an integrated value N for the determination signal 100, and the like, during this integration time period signal 222.

The integrated value N determined in this manner is compared with the first threshold value Nth1 in the first comparator 204A, thereby generating a first comparison result 203A, and furthermore, it is also compared with the second threshold value Nth2 in the second comparator 204B, thereby generating a second comparison result 203B.

In other words, the integration unit 202 derives a common integrated value N for the first comparator 204A and the second comparator 204B, and compares this integrated value N with different threshold values (the first threshold value Nth1 and the second threshold value Nth2), thereby obtaining two comparison results corresponding respectively to the first integrated value N1 and the second integrated value N2.

Furthermore, in the mode shown in FIG. 13, the judgment signal generating unit 500 has a composition which includes a logical circuit 502 (in this case, an AND circuit), and this generates a two-bit judgment signal comprising: the logical product 209C of the first judgment signal 209A read out from the first comparison result register 208A at the first judgment signal sampling timing (by means of the first sampling signal 280 indicating the first judgment signal sampling timing) and the inverted logic signal of the second judgment signal 209B read out from the second comparison result register 208B at the second judgment signal sampling timing (by means of the second sampling signal 282 indicating the second judgment signal sampling timing); and the second judgment signal 209B itself.

More specifically, if the first judgment signal 209A and the second judgment signal 209B both indicate a normal state, then it is possible to judge that the nozzle 51 is in a normal ejection state. Furthermore, if the second judgment signal 209B indicates an abnormal state, regardless of the first judgment signal 209A, then it can be judged that an ejection abnormality has occurred in the nozzle 51 due to blocking of the nozzle.

Moreover, if the first judgment signal 209A indicates an abnormal state, and the second judgment signal 209B indicates a normal state, then it can be judged that an ejection abnormality has occurred in the nozzle 51 due to intermixing of an air bubble. In other words, in the composition of the ejection abnormality judgment unit 90 shown in FIG. 13, it is possible to judge not only the presence or absence of an ejection abnormality, but also whether the cause of the ejection abnormality is the occurrence of an air bubble inside the pressure chamber 52, or the occurrence of a blockage in the nozzle 51.

Figure 14:
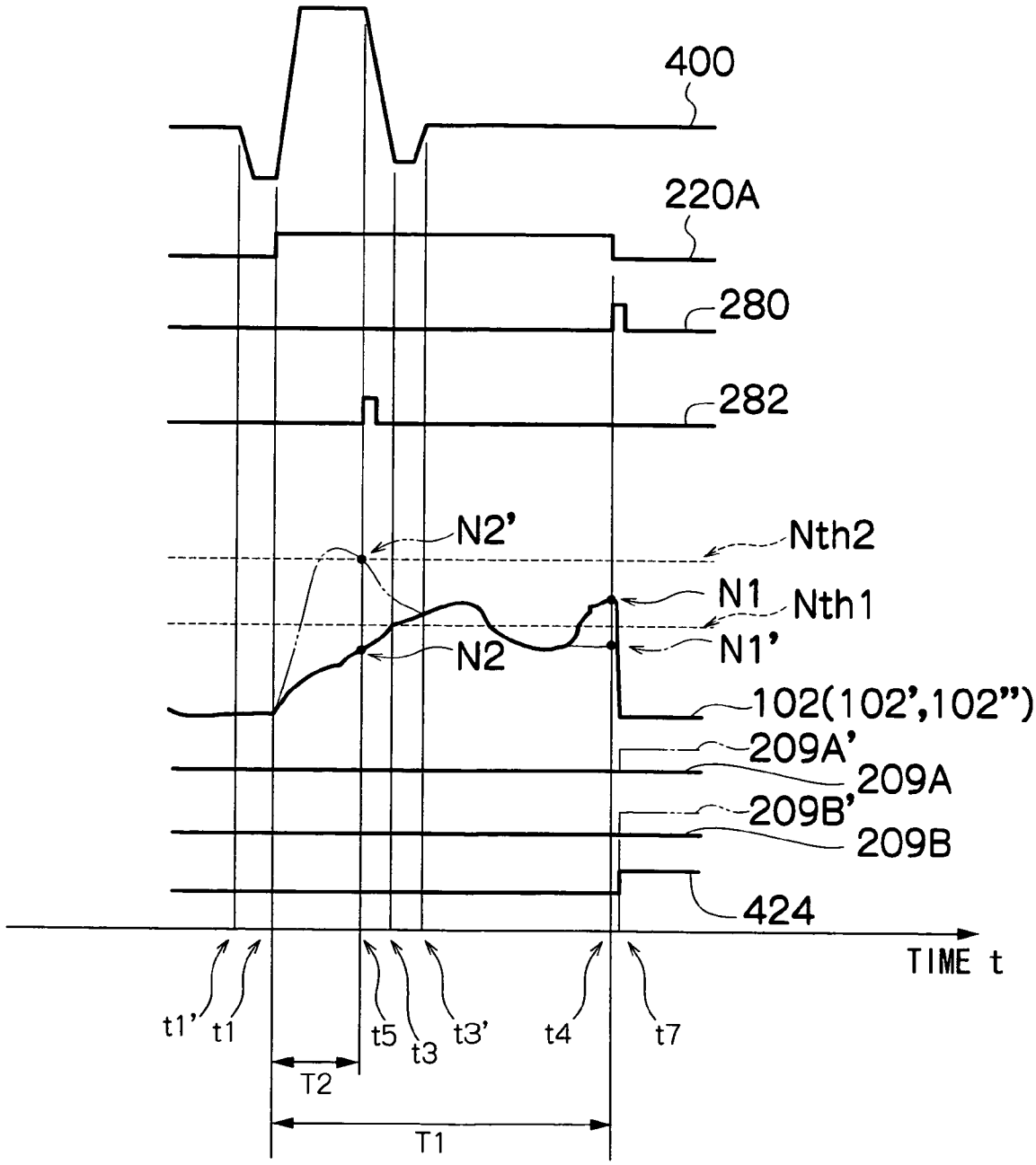
FIG. 14 is a diagram showing the relationship between the respective signals in the ejection abnormality judgment unit shown in FIG. 13.

FIG. 14 shows the timings of the respective signals in the ejection abnormality judgment unit 90 shown in FIG. 13. In FIG. 14, items which are the same as or similar to those in FIG. 12 are labeled with the same reference numerals and description thereof is omitted here.

The reference numeral 282 shown in FIG. 14 is a second judgment signal sampling signal which samples the second comparison result 203B recorded in the second comparison result register 310B shown in FIG. 13, at the end timing t5 of the second integration time period T2.

More specifically, the time period from timing t1 until timing t5 corresponds to the second integration time period T2, and by sampling a second comparison result 203B obtained by comparing the second integrated value N2 (N2') with the second threshold value Nth2 at timing t5, it is possible to obtain a second judgment signal 209B.

The integrated value N2' at timing t5 of the integrated value curve indicated by the double-dotted line in FIG. 14 (which corresponds to the integrated value curve 102" shown in FIGS. 9A and 9B) exceeds the second threshold value Nth2. In this case, the second judgment signal 209B' shown by the double-dotted line, which indicates an ejection abnormality state in the nozzle 51 (an ejection abnormality due to a nozzle blockage), can be obtained at the prescribed judgment timing t7.

In other words, the second judgment signal 209B (209B') indicates the judgment result of judging the presence/absence of an ejection abnormality due to a nozzle blockage.

On the other hand, if the second comparison result 203B sampled at timing t5 indicates a normal state and the first comparison result 203A sampled at timing t4 indicates an abnormal state, then a first judgment signal 209A' indicating an ejection abnormality at the nozzle 51 due to the occurrence of an air bubble inside the pressure chamber 52 can be obtained at timing t7 (shown by the single-dotted line).

When the judgment signals 209A and 209B (209A' and 209B') are obtained at timing t7, the integrated values N1 and N2 (the comparison result 203A recorded in the first comparison result register 310A and the comparison result 203B recorded in the second comparison result register 310B) are reset at a prescribed timing after the timing t7.

More specifically, in the ejection abnormality judgment shown in the present embodiment, the presence or absence of an ejection abnormality due to a nozzle blockage is indicated by the first judgment signal 209A (209A'), and the presence or absence of an ejection abnormality due to the occurrence of an air bubble inside the pressure chamber 52 is indicated by the second judgment signal 209B (209B'). However, if both the first judgment signal 209A and the second judgment signal 209B indicate an abnormality, then it cannot be judged whether this is an ejection abnormality due to a blockage of the nozzle 51, or an ejection abnormality due to an air bubble.

Furthermore, if the first judgment signal 209A indicates a normal state and the second judgment signal 209B indicates an abnormal state, then it is possible to obtain an air bubble judgment signal 424 which indicates that the cause of the ejection abnormality is the occurrence of an air bubble. The air bubble judgment signal 424 shown in FIG. 14 corresponds to the judgment signal 209C obtained from the logic circuit 502 shown in FIG. 13.

In the inkjet recording apparatus 10 having the composition described above, an integrated value N is determined by integrating a determination signal 100, and so on, obtained from the piezoelectric element 58 which applies pressure to the pressure chamber 52, this integrated value N is compared with a previously established threshold value Nth, and an ejection abnormality in the related nozzle is determined on the basis of the comparison result. Therefore, even if a piezoelectric type of pressure sensor, which outputs a very weak current (or voltage), is used for pressure determination, it is still possible to suppress the effects of noise and to achieve accurate ejection abnormality determination.

Furthermore, the piezoelectric element 58 is driven to perform ejection in such a manner that the pressure wave is damped effectively after ejection, in order that repeated ejections can be performed efficiently at high speed, but if an air bubble is present in the pressure chamber 52, then this appears as a residual vibration due to decline in the maximum value of the pressure (peak pressure) and divergence in the resonance frequency. In all cases, this in turn causes a reduction of the integrated value N of the determination signal 100, and therefore determination of ejection abnormalities on the basis of this integrated value N is efficient and accurate.

Moreover, since there are two integration time periods, comprising an integration time period T1 corresponding to the full range of the pressure wave from the start timing of the application of the drive signal until the suppression of the residual vibration, and an integration time period T2 corresponding to the maximum value of the pressure, and since the presence or absence of an ejection abnormality is judged by comparing the integrated values N1 and N2 determined for these respective integration time periods with the threshold values Nth1 and Nth2 corresponding to these respective integration time periods, then it is possible to determine the maximum value of the pressure wave, and residual vibrations in the pressure wave, in an independent fashion.

Adaptation Example

Next, an example of an adaptation of the present embodiment will be described.

In ejection abnormality determination based on integrated values N, it is difficult to distinguish cases where an ejection abnormality has occurred but there is no residual vibration, or cases where the amplitude of the residual vibration is substantially equal in the positive direction and the negative direction, and the like, from cases where ejection is normal.

In the present adaptation, in order to resolve this problem, an integrated absolute value M is derived by integrating the absolute value of the determination signal 100, and so on, shown in FIG. 7A, FIG. 8A and FIG. 9A, and ejection abnormality determination for the nozzle 51 is made on the basis of this integrated absolute value M.

Figure 15:
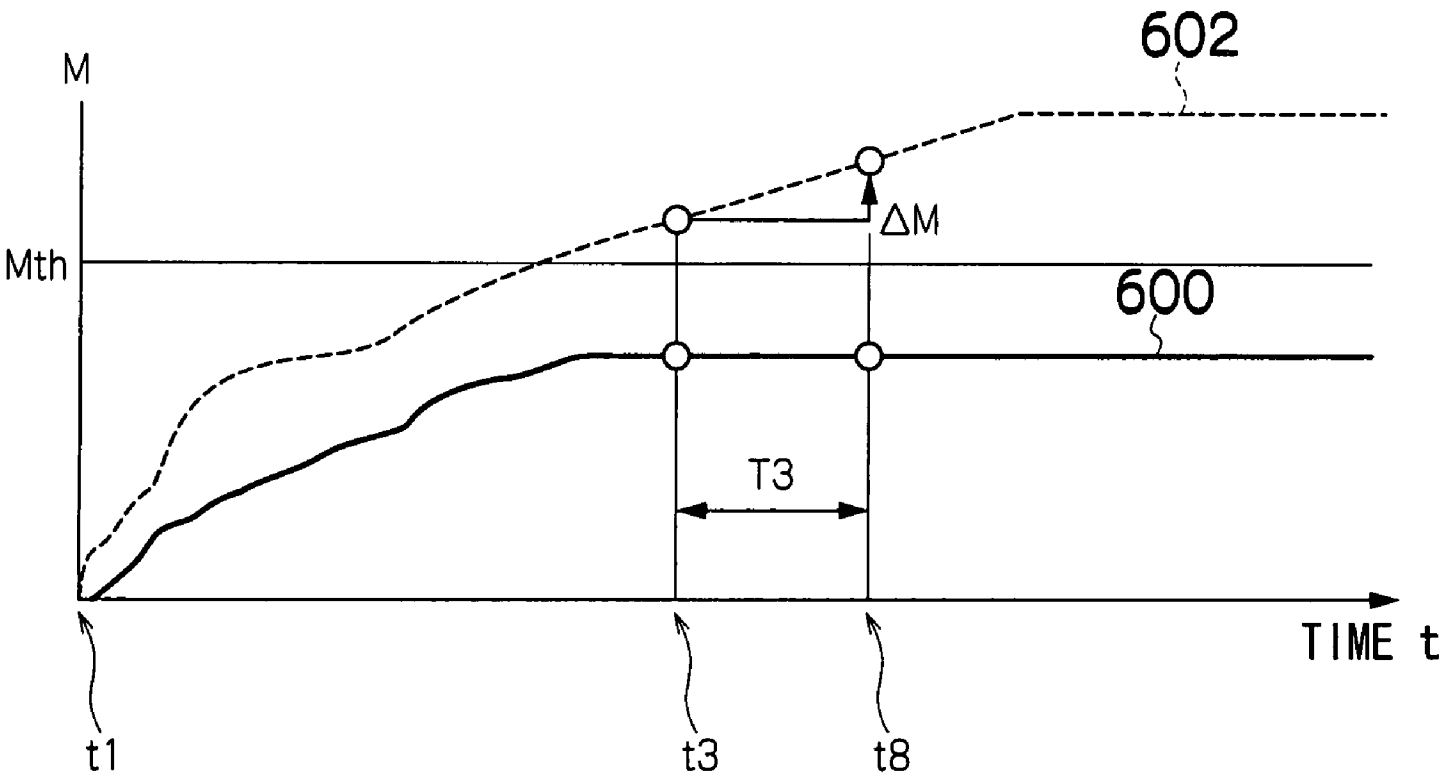
FIG. 15 is a diagram showing ejection abnormality judgment using the integrated value of the absolute value of the determination signal.

FIG. 15 shows the integrated absolute value M for the determination signal 100, and so on, shown in FIG. 7A, FIG. 8A and FIG. 9A. In FIG. 15, the horizontal axis shows the time t, and the vertical axis shows the integrated absolute value M. Furthermore, the curve 600 shown by the solid line indicates the integrated absolute value M during normal ejection and the curve 602 shown by the broken line indicates the integrated absolute value M in the case of an ejection abnormality.

In FIG. 15, the time period T3 from the timing t1 until the timing t3 indicates the time period during which an ejection operation is performed, and in this time period, the integrated absolute value M increases constantly, due to the change in the pressure of the pressure chamber 52.

The time period T3 from timing t3 until timing t8 is set to a time period until the residual vibration is sufficiently damped, and in this time period, the change in the pressure wave is extremely small in the case of normal ejection, and the integrated absolute value M is virtually uniform.

On the other hand, in the event of an ejection abnormality, the resonance frequency is shifted and the residual vibration is not damped sufficiently. Therefore, the integrated absolute value M tends to continue to rise, as shown by curve 602.

More specifically, it is possible to judge an ejection abnormality on the basis of the amount of increase ΔM of the integrated absolute value M in the time period T3 from timing t3 until timing t8. Of course, it is also possible to set a threshold value Mth (third threshold value) corresponding to the integrated absolute value M, and to determine the presence or absence of an ejection abnormality in the nozzle 51 from the result of a comparison between the threshold value Mth and the integrated absolute value M. Desirably, a composition is adopted in which the threshold value Mth can be switched selectively in accordance with the drive signal, and furthermore, desirably, the threshold value Mth is recorded previously in the form of a database.

In order to integrate the absolute value of the determination signal 100, and so on, a composition should be adopted in which an absolute value converting unit (absolute value circuit) is provided before the integration unit 202 of the ejection abnormality judgment unit 90 shown in FIG. 10, FIG. 11 and FIG. 13.

The timing t8 in this adaptation may be set in accordance with the drive signal which drives the piezoelectric element 58, and it may be provided in advance as a system parameter.

If the presence or absence of an ejection abnormality is determined on the basis of an integrated absolute value M derived by integrating the absolute value of the determination signal 100, and so on, as shown in this adaptation, then it is possible to determine the presence or absence of residual vibration of the pressure wave close to free vibration, in an efficient manner. Furthermore, it is also possible readily to determine a pressure abnormality due to a nozzle blockage (namely, increase in the amplitude of the pressure wave and reduced damping of the residual vibration).

It is also possible to adopt a composition in which two types of integrated value are derived, namely, an integrated value N obtained by simply integrating the determination signal 100, and so on (adding positive numbers and subtracting negative numbers), and an integrated absolute value M obtained by integrating the absolute value of the determination signal 100, and so on, in such a manner that ejection abnormalities can be judged on the basis of these two types of integrated values.

In the above-described embodiments, an inkjet recording apparatus which forms images on recording paper 16 by ejecting ink from nozzles 51 has been described, but the scope of application of the present invention is not limited to this and it may also be applied to a liquid ejection apparatus which ejects a liquid such as water, liquid chemical, treatment liquid, or the like, from ejection holes.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

an ejection head which includes: a nozzle through which a droplet of liquid is ejected onto an ejection receiving medium; a pressure chamber which accommodates the liquid to be ejected from the nozzle; and a piezoelectric element which is provided at the pressure chamber and applies an ejection force to the liquid inside the pressure chamber;

a pressure sensor which is provided at the pressure chamber and the pressure sensor generates a determination signal corresponding to pressure in the pressure chamber;

an integration device which integrates the determination signal corresponding to pressure in the pressure chamber obtained by the pressure sensor for a prescribed integration time period to obtain an integration result; and an ejection abnormality judgment device which judges whether or not an ejection abnormality occurs in the nozzle, according to a comparison result of comparing the integration result obtained from the integration device with a previously established threshold value.

2. The liquid ejection apparatus as defined in claim 1, wherein:

the integration time period comprises: a first integration time period including an end time of a drive signal supplied to the piezoelectric element during one ejection operation and having a time period after an end of the drive signal which exceeds a half of a resonance period of a liquid ejection system of the ejection head; and a second integration time period including a time period during which the drive signal is supplied to the piezoelectric element in one ejection operation, and having a time period shorter than the first integration time period;

the threshold value includes a first threshold value specified in accordance with the first integration time period and a second threshold value specified in accordance with the second integration time period; and the ejection abnormality judgment device judges whether or not an ejection abnormality occurs in the nozzle according to at least one comparison result of a first comparison result obtained by comparing an integrated value for the first integration time period with the first threshold value, and a second comparison result obtained by comparing an integrated value for the second integration time period with a second threshold value.

3. The liquid ejection apparatus as defined in claim 2, wherein an ejection abnormality in the nozzle due to an occurrence of an air bubble in at least one of the nozzle and the pressure chamber is judged from the first and second comparison results.

4. The liquid ejection apparatus as defined in claim 2, wherein an ejection abnormality in the nozzle due to increased viscosity of the liquid inside the nozzle is judged from the second comparison result.

5. The liquid ejection apparatus as defined in claim 2, wherein the first integration time period and the second integration time period have a common start timing.

6. The liquid ejection apparatus as defined in claim 1, wherein the integration device calculates an integrated absolute value by integrating an absolute value of the determination signal.

7. The liquid ejection apparatus as defined in claim 6, further comprising: a calculation device which determines an amount of increase in the integrated absolute value, wherein the ejection abnormality judgment device judges an ejection abnormality in the nozzle according to the amount of increase in the integrated absolute value determined by the calculation device.

8. The liquid ejection apparatus as defined in claim 1, wherein the pressure sensor is directly arranged on a wall that defines the pressure chamber.

9. The liquid ejection apparatus as defined in claim 1, wherein the pressure sensor detects a distortion corresponding to the pressure in the pressure chamber.

10. The liquid ejection apparatus as defined in claim 1, wherein the piezoelectric element also serves as the pressure sensor.

11. An ejection abnormality determination method for an ejection head which includes: a nozzle through which a droplet of liquid is ejected onto an ejection receiving medium; a pressure chamber which accommodates the liquid to be ejected from the nozzle; and a piezoelectric element which is provided at the pressure chamber and applies an ejection force to the liquid inside the pressure chamber, the method comprising the steps of:

acquiring a determination signal corresponding to pressure in the pressure chamber;

integrating the determination signal corresponding to pressure in the pressure chamber to obtain an integration result; and judging whether or not an ejection abnormality occurs in the nozzle, according to a comparison result obtained by comparing an integration result obtained in the integration step with a previously established threshold value.

* * * * *